US012644402B2

(12) United States Patent
Lawrence et al.

(10) Patent No.: US 12,644,402 B2
(45) Date of Patent: Jun. 2, 2026

(54) OIL SEPARATION DEVICE AND ARRAY FOR INTERNAL COMBUSTION ENGINE

(71) Applicant: Caterpillar Inc., Peoria, IL (US)

(72) Inventors: Rodney Allen Lawrence, Frankfort, IN (US); Joshua Amiel Lehe, West Lafayette, IN (US); Chetan Vishwanath Kulkarni, West Lafayette, IN (US); Brandyn A. Stack, Lafayette, IN (US); Yegor Litvinov, Shakopee, MN (US); Mircea Radu Farmus, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/904,617

(22) Filed: Oct. 2, 2024

(65) Prior Publication Data

US 2026/0092543 A1 Apr. 2, 2026

(51) Int. Cl.
*F01M 13/04* (2006.01)

(52) U.S. Cl.
CPC ..... *F01M 13/04* (2013.01); *F01M 2013/0438* (2013.01)

(58) Field of Classification Search
CPC ..... F01M 13/04; F01M 2013/0438; F01M 2013/0472; F01M 2013/005; F01M 2013/0072; B01D 46/2411; B01D 46/62; B01D 46/58; B01D 46/60; B01D 46/64
USPC ..... 123/573, 572, 41.86; 55/DIG. 19; 96/190, 191; 95/273
See application file for complete search history.

(56) References Cited

U.S. PATENT DOCUMENTS

| | | | |
|---|---|---|---|
| 2,642,052 | A | 6/1953 | Wagner et al. |
| 4,768,493 | A | 9/1988 | Ohtaka et al. |
| 5,171,338 | A | 12/1992 | Baert |
| 5,277,154 | A | 1/1994 | Mcdowell |
| 5,450,835 | A | 9/1995 | Wagner |
| 5,456,239 | A | 10/1995 | Henderson et al. |

(Continued)

FOREIGN PATENT DOCUMENTS

| | | |
|---|---|---|
| CN | 1070428 | 9/2001 |
| CN | 203436916 | 2/2014 |

(Continued)

OTHER PUBLICATIONS

"U.S. Appl. No. 18/092,525, Non Final Office Action mailed Sep. 28, 2024", 8 pgs.

(Continued)

*Primary Examiner* — George C Jin
*Assistant Examiner* — Teuta B Holbrook

(57) ABSTRACT

Apparatuses including an oil separation device are discussed and shown. The oil separation device can optionally include a jacket arranged between an inner housing and an outer housing. The inner housing has an inner cavity that receives a filter configured to separate the oil from a blow-by gas. A first inlet port is positioned to extend generally tangentially relative to the jacket and a first outlet port is positioned to extend generally tangentially relative to the jacket. The oil separation device can include a first cover and a second cover coupled to or integral with at least the outer housing at opposing end portions. The first cover and the second cover are configured to receive the blow-by gas and to pass the blow-by gas as desired.

5 Claims, 17 Drawing Sheets

(56) References Cited

U.S. PATENT DOCUMENTS

| | | | |
|---|---|---|---|
| 5,937,837 | A | 8/1999 | Shaffer et al. |
| 6,234,154 | B1 | 5/2001 | Spix |
| 6,561,171 | B2 | 5/2003 | Burgess |
| 6,691,687 | B1 | 2/2004 | Liang et al. |
| 6,702,941 | B1 | 3/2004 | Haq et al. |
| 7,011,690 | B2 | 3/2006 | Altvater et al. |
| 7,182,864 | B2 | 2/2007 | Brown et al. |
| 7,311,208 | B2 | 12/2007 | Brown et al. |
| 7,635,409 | B2 | 12/2009 | Mahoney et al. |
| 8,210,135 | B2 | 7/2012 | Slaughter et al. |
| 8,657,901 | B2 | 2/2014 | Chapman |
| 9,169,808 | B2 | 10/2015 | Kitagawa |
| 9,222,698 | B2 | 12/2015 | Mcclanahan et al. |
| 9,447,714 | B2 | 9/2016 | Khan et al. |
| 9,581,061 | B2 | 2/2017 | Kurita et al. |
| 9,650,927 | B2 | 5/2017 | Subedi et al. |
| 9,677,507 | B2 | 6/2017 | Kurosawa et al. |
| 9,702,282 | B2 | 7/2017 | Peck et al. |
| 9,926,888 | B2 | 3/2018 | Okawa et al. |
| 10,001,040 | B2 | 6/2018 | Copley et al. |
| 10,184,444 | B2 | 1/2019 | Plenk |
| 10,213,715 | B2 | 2/2019 | South et al. |
| 10,543,442 | B2 | 1/2020 | Janakiraman et al. |
| 10,550,742 | B2 | 2/2020 | Zuerker et al. |
| 10,704,434 | B2 | 7/2020 | Akita et al. |
| 10,876,445 | B2 | 12/2020 | Kress et al. |
| 10,876,631 | B2 | 12/2020 | Zuerker et al. |
| 11,311,829 | B2 | 4/2022 | Nelson et al. |
| 11,331,606 | B2 | 5/2022 | Roy et al. |
| 11,839,842 | B2 | 12/2023 | Piva et al. |
| 11,946,397 | B1 | 4/2024 | Lawrence et al. |
| 12,023,619 | B2 | 7/2024 | Parikh et al. |
| 2003/0102257 | A1 | 6/2003 | Reid |
| 2004/0089600 | A1 | 5/2004 | Haq et al. |
| 2006/0090651 | A1 | 5/2006 | Liu et al. |
| 2008/0035103 | A1 | 2/2008 | Barris et al. |
| 2009/0199794 | A1 | 8/2009 | Slaughter et al. |
| 2010/0051388 | A1 | 3/2010 | Clark et al. |
| 2014/0182569 | A1 | 7/2014 | Hwang et al. |
| 2017/0014745 | A1 | 1/2017 | Zuerker et al. |
| 2019/0218947 | A1 | 7/2019 | Akita et al. |
| 2022/0314148 | A1 | 10/2022 | Calcaterra et al. |
| 2023/0313750 | A1 | 10/2023 | Li et al. |
| 2024/0218817 | A1 | 7/2024 | Lawrence et al. |

FOREIGN PATENT DOCUMENTS

| | | | | |
|---|---|---|---|---|
| CN | 107701263 | | 2/2018 | |
| CN | 107701263 | A | 2/2018 | |
| CN | 207420558 | | 5/2018 | |
| CN | 108993050 | | 12/2018 | |
| CN | 109424388 | | 10/2020 | |
| CN | 111927594 | | 11/2020 | |
| CN | 112824656 | | 5/2021 | |
| CN | 112901309 | | 6/2021 | |
| CN | 222208049 | U * | 12/2024 | |
| DE | 102004031619 | | 2/2006 | |
| DE | 10310452 | | 8/2008 | |
| EP | 0774289 | | 5/1997 | |
| EP | 1762293 | A2 * | 3/2007 | ..... B01D 46/0013 |
| EP | 2478949 | | 7/2012 | |
| EP | 1965045 | | 12/2012 | |
| EP | 2934716 | | 10/2015 | |
| JP | 2007247448 | | 9/2007 | |
| JP | 4448418 | | 1/2010 | |
| JP | 5085523 | | 9/2012 | |
| JP | 6126885 | | 4/2017 | |
| JP | 2017066963 | | 4/2017 | |
| KR | 101714717 | B1 | 3/2017 | |
| KR | 20210009662 | | 1/2021 | |
| KR | 20220104883 | | 7/2022 | |
| WO | 2015108853 | A1 | 7/2015 | |
| WO | 2020064205 | | 4/2020 | |

OTHER PUBLICATIONS

Written Opinion and International Search Report for Int'l. Patent Appln. No. PCT/US2025/046128, mailed Dec. 11, 2025 (14 pgs).

* cited by examiner

OIL SEPARATION DEVICE AND ARRAY FOR INTERNAL COMBUSTION ENGINE

TECHNICAL FIELD

The present disclosure relates to crankcase ventilation systems for internal combustion engines such as those for vehicles or stationary power generation. More particularly, the present disclosure relates to oil separating devices for crankcase ventilation systems including arrays of such oil separating devices.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel in cylinders and thereby produce drive torque and power. A portion of the combustion gases (termed "blow-by" gas) may escape the combustion chamber past the piston and enter undesirable areas of the engine such as the crankcase. Blow-by gas can contain un-combusted fuel, oil and explosive gases. In rare cases, un-combusted fuel and/or explosive gases can build within the engine such as within the crankcase. The un-combusted fuel and/or explosive gases can result in an explosion if not properly mitigated such as by a relief valve. Crankcase ventilation systems are known in combustion engines to vent, capture or dilute blow-by gases of the crankcase. Such ventilation systems can include oil separation devices as part of such systems. For example, European Patent Application Publication No. 2478949A2, U.S. Pat. Nos. 8,657,901B2 and 5,450,835A disclose examples of oil separation devices. However, this patent application and the patents do not recognize various features and components of the present application.

SUMMARY

In an example according to this disclosure, an apparatus for separating oil from a blow-by gas of an engine optionally including: an inner housing that defines an inner cavity; an outer housing having a first inlet port and a first outlet port, a filter, a first cover and a second cover. The inner housing is positioned within the outer housing and the inner housing and the outer housing form a jacket therebetween. The first inlet port is positioned to extend generally tangentially relative to the jacket and the first outlet port is positioned to extend generally tangentially relative to the jacket. The filter is configured to separate the oil from the blow-by gas positioned within the inner cavity. The first cover is coupled to or integral with at least the outer housing at a first end portion thereof. The first cover is in fluid communication with the filter, and wherein the first cover is configured to receive the blow-by gas and to pass the blow-by gas from the first cover. The second cover is coupled to or integral with at least the outer housing at a second end portion thereof. The second cover is in fluid communication with the filter, and wherein the second cover is configured to receive the blow-by gas and to pass the blow-by gas from the second cover.

In another example according to this disclosure, an engine system optionally including: an array of oil separating apparatuses, the array of the oil separating apparatuses includes an assembly of at least a first oil separating apparatus and a second oil separating apparatus that are physically coupled together. The first oil separating apparatus optionally includes a first jacket and the second oil separating apparatus optionally includes a second jacket. The first jacket is in fluid communication with the second jacket via a first jumper tube, wherein, via a first inlet port. The first jacket receives a fluid flowing in a generally tangential direction relative to the first jacket and circulates the fluid from the first inlet port around the first jacket to a first outlet port communicating with the first jumper tube. The first outlet port and the first jumper tube are positioned to extend generally tangentially relative to the first jacket. A first one or more fluid lines can pass a blow-by gas from an engine to the array of the oil separating apparatuses. Oil is separated from the blow-by gas by passing through a first filter of the first oil separating apparatus and a second filter of the second oil separating apparatus. The first jacket surrounds and is sealed as to be entirely separated from the first filter and the second jacket surrounds and is sealed so as to be entirely separated from the second filter. The first jacket thermally protects the first filter and the second jacket thermally protects the second filter. A second one or more fluid lines can pass the blow-by gas from the array of the oil separating apparatuses back to the engine.

In yet another example according to this disclosure, a method of separating oil from a blow-by gas of an engine, the method optionally including: passing the blow-by gas to a first oil separating apparatus and a second oil separating apparatus, wherein the first oil separating apparatus and the second oil separating apparatus are in fluid communication with one another via a first jumper tube that communicates between a first jacket of the first oil separating apparatus and a second jacket of the second oil separating apparatus; passing the blow-by gas through at least one of a first filter of the first oil separating apparatus or a second filter of the second oil separating apparatus; removing the oil from the blow-by gas using one or both of the first filter or the second filter; heating or cooling at least the first filter by introducing a fluid tangentially into the first jacket and by circulating the fluid around the first jacket to exit the first jacket tangentially at the first jumper tube; and passing the blow-by gas from the first oil separating apparatus and the second oil separating apparatus back to the engine.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples according to this disclosure are directed to an oil separation device(s) for internal combustion engines, and to systems and methods for filtering oil to separate oil and other forms of particulate matter from blow-by gas. Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

Figure 1:
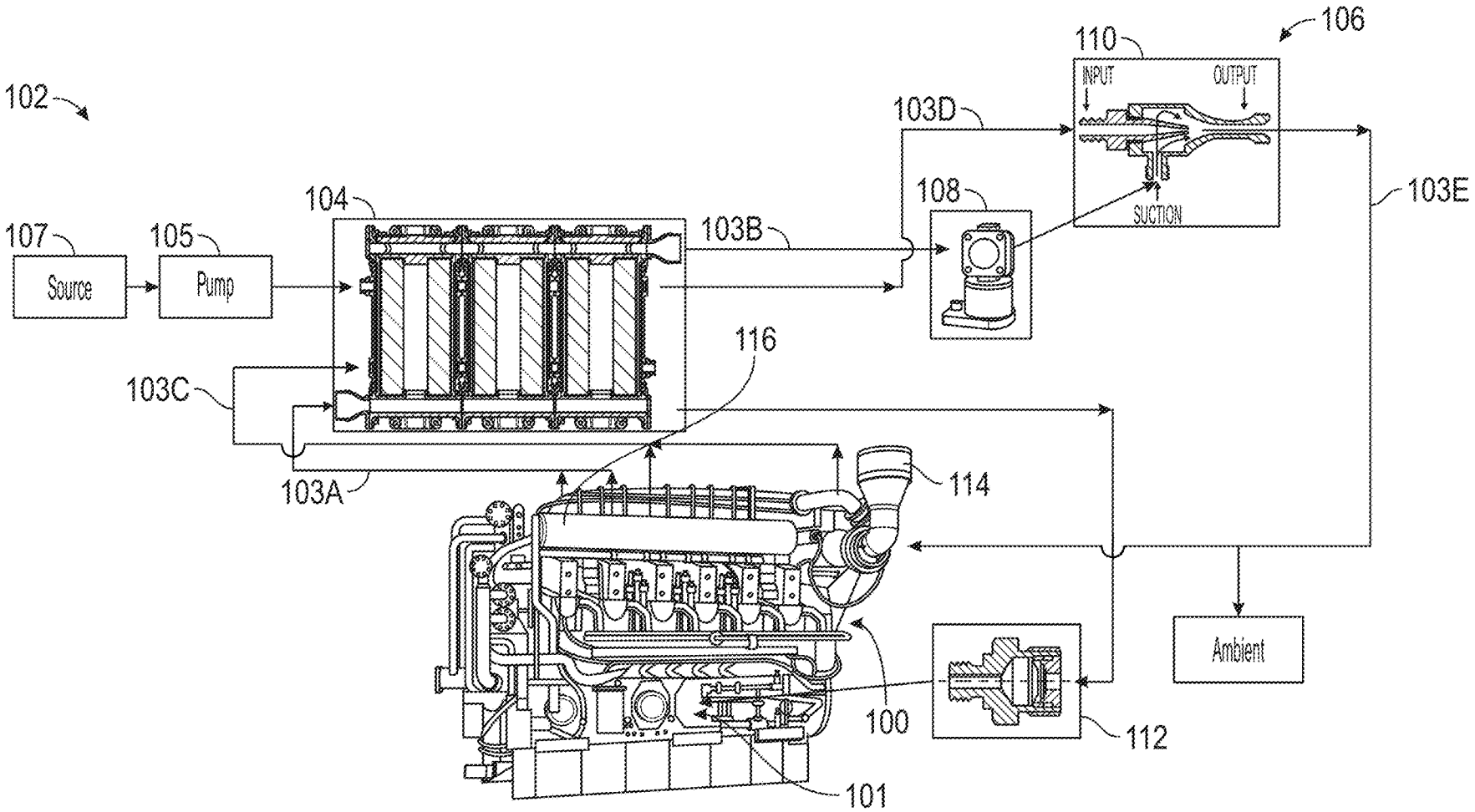
FIG. 1 is schematic illustration depicting an example internal combustion engine with a system including a blow-by gas oil separation device in accordance with an example of the present application.

FIG. 1 depicts an example schematic illustration of an engine 100 in accordance with this disclosure. The engine 100 can be used for power generation such as for the propulsion of vehicles or other machinery. The engine 100 can include various power generation platforms, including, for example, an internal combustion engine, whether gasoline, natural gas, dynamic gas blending, or diesel. It is understood that the present disclosure can apply to any number of piston-cylinder arrangements and a variety of engine configurations including, but not limited to, V-engines, inline engines, and horizontally opposed engines, as well as overhead cam and cam-in-block configurations.

In some applications, the internal combustion engines disclosed here are contemplated for use in gas compression. Thus, the internal combustion engines can be used in stationary applications in some examples. In other applications the internal combustion engines disclosed can be used with vehicles and machinery that include those related to various industries, including, as examples, oil exploration, construction, agriculture, forestry, transportation, material handling, waste management, etc. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% or degrees of a stated value.

The engine 100 can include a system 102 with at least one oil separation device 104 (or an array of a plurality of oil separation devices 104 as shown). The system 102 can include auxiliary components 106 to the engine 100 such as a regulator 108, jet pump 110 and a check valve 112. The check valve 112 can be placed, for example, at the bottom of the oil drain sub-system to prevent unfiltered blow-by gas from bypassing a coalescing filter of the oil separation device 104 and passing directly to a compressor 114. Thus, the check valve 112 can regulate the flow of oil.

In the example of FIG. 1, the system 102 can be part of the original manufacture of the engine 100 or can be a retrofitted system that is added to the engine 100 during maintenance, upgrade or the like. As will be discussed in further detail subsequently, the system 102 can use the oil separation device(s) 104 to filter oil from the blow-by gas to reduce volatile content in the blow-by gas.

The system 102 can be part of a purge system, which can be in fluid communication with a crankcase 101 of the engine 100 such as via an inlet passageway. The system 102 can be configured to supply air to the crankcase and through the engine block or through other components (not shown) to a cylinder head of the engine 100. The air the system 102 supplies can act to ventilate the crankcase 101 and other components of the engine 100 such as the cylinder head, the rocker box, etc. This ventilation, in addition to operation of the oil separation device(s) 104 to separate oil from the blow-by gas, can dilute un-combusted fuel, explosive gases and/or volatiles below a lower explosive limit so as to prevent or reduce the likelihood of an explosion within the engine 100.

The system 102 can include connected passages (some specifically illustrated by arrows and numbered in FIG. 1) that are in fluid communication with various components of the system 102. Some components of the engine 100 such as the engine block, the crankcase 101, the cylinder head, the rocker box, the valve cover and/or the breather can be in fluid communication. The terms "passage", "passages", "passageway", "passageways", "line" or "lines" as used herein should be interpreted broadly. These terms can be features defined by the various components of the engine illustrated in the FIGURES or can be formed by additional components (e.g., a hose, tube, pipe, manifold, cavity etc.) as known in the art. These additional components can be external to the engine 100 in some examples. Passageways can also connect the regulator 108, the jet pump 110 and the check valve 112 with selected parts of the oil separation device(s) 104 as further described herein.

The system 102 can include passages and other components such as those shown in FIG. 1. Dirty blow-by gas containing oil and volatiles of the system 102 can pass along a passage 103A from a breather or other device of the engine 100 and can pass to the oil separation device(s) 104 for filtering of oil to reduce volatile content of the blow-by gas. The blow-by gas, after filtering of the oil, can pass from the oil separation device(s) 104 along passage 103B to the regulator 108 (e.g., a vacuum control valve, mechanical valve or similar regulating device) located between the oil separation device(s) 104 and the jet pump 110. The blow-by gas can pass from the regulator 108 to the suction of the jet pump 110. The regulator 108 (e.g., the vacuum control valve) can be in fluid communication with the blow-by gas. The regulator 108 can be configured to regulate a flow of the blow-by gas to control a vacuum of the jet pump 110.

In tandem with the blow-by gas, the system 102 can utilize a fluid such as boost air from the compressor 114 (or other component such as a turbocharger) and/or air from an aftercooler 116, which moves along passage 103C. This boost air can be mixed in a desired ratio and passed through one or more jackets of the oil separation device(s) 104. Such arrangement can keep the filter of each of the oil separation device(s) 104 at between about 80 degrees Celsius and 120 degrees Celsius, for example. The boost air can be mixed to achieve a temperature range above the dew point temperature of the blow-by gas and below a temperature at which one or more components of the oil separating apparatus become inoperable (fail due to melting or other modality). However, other examples contemplate the use of alternative fluids, fluid temperatures and/or other configurations for the system 102. For example, the system 102 can utilize another fluid such as engine coolant, engine jacket water or engine lube oil can be circulated by a pump 105 from a source 107 to the jacket of the oil separating apparatus 104.

After leaving the jacket(s), the boost air, now at a reduced pressure and temperature from a pressure and temperature leaving the engine 100, can pass along passage 103D to an input of the jet pump 110. The jet pump 110 can use the boost air as motive air for drawing the blow-by gas through the oil separation device(s) 104. The blow-by gas after leaving the oil separation device(s) 104 can be routed to a suction port of the jet pump 110. The boost air can be routed to an inlet port of the jet pump 110. The blow-by gas and the boost air can be combined in the jet pump 110. In particular, jet pump 110 can be configured to pass the blow-by gas and the boost air through a venturi of the jet pump 110. Some or all of the combined motive air and blow-by gas can pass along passage 103E to be returned to the engine 100, for example as an inlet to the compressor 114. Some or all of the combined motive air and blow-by gas can also be routed to ambient. The air can pass to the compressor 114, which can be configured to receive and compress the air. The compressed air can pass from the compressor 114 to the aftercooler 116. Thus, the aftercooler 116 can be in fluid communication with the compressor 114. The aftercooler 116 can be configured to receive and cool at least a portion of the compressed air.

To briefly summarize, the crankcase 101 can having a blow-by gas passing therethrough. The oil separation device(s) 104 can be in fluid communication with the blow-by gas and configured to separate oil from the blow-by gas. A mass flow rate of the boost air can be between 0.5% and 2.5% of a mass flow rate of the air received by the compressor 114. The boost air can be passed through the oil separation device(s) 104 in a heat exchange relationship with the blow-by gas to maintain a temperature of the blow-by gas within the oil separation device(s) 104 at a desired temperature range. The system 102 can include the jet pump 110 can be in fluid communication with both the blow-by gas after leaving the oil separation device(s) 104 and the boost air after leaving the oil separation device(s) 104. The jet pump can be configured to combine the blow-by gas and the boost air. After leaving the jet pump, the combined blow-by gas and the boost air can be routed to at least one of the compressor 114 or ambient.

Put another way, the system 102 can be configured to ratio compressor outlet boost air with aftercooler output air. This ratio of air can target a temperature somewhere between 80 degree Celsius to 120 degrees Celsius. Thus, the compressed air from the compressor 114 and cooled air from the aftercooler 116 can be mixed to achieve boost air at a temperature range of between 80° C. and 120° C., inclusive. This mixture of air can be fed to the jacket of each of the oil separation device(s) 104 the keep the filter of each of the oil separation device(s) 104 at between about 80 degrees Celsius and 120 degrees Celsius, for example. This mixture of air, after passing through the jacket of the oil separation device(s) 104, can be fed to the jet pump 110 as motive air. Passage of the motive air through the jet pump 110 can create a vacuum that can be modulated by the regulator 108 (e.g., vacuum control valve or a mechanical valve). The regulator 108 can modulate the vacuum at the outlet of the system 102 and can regulate crankcase pressure (via flow of blow-by gas to the suction of the jet pump 110). Additionally, the filter(s) of the oil separation device(s) 104 is heated, cooled or maintained at a desired temperature using the boost air.

Figure 2:
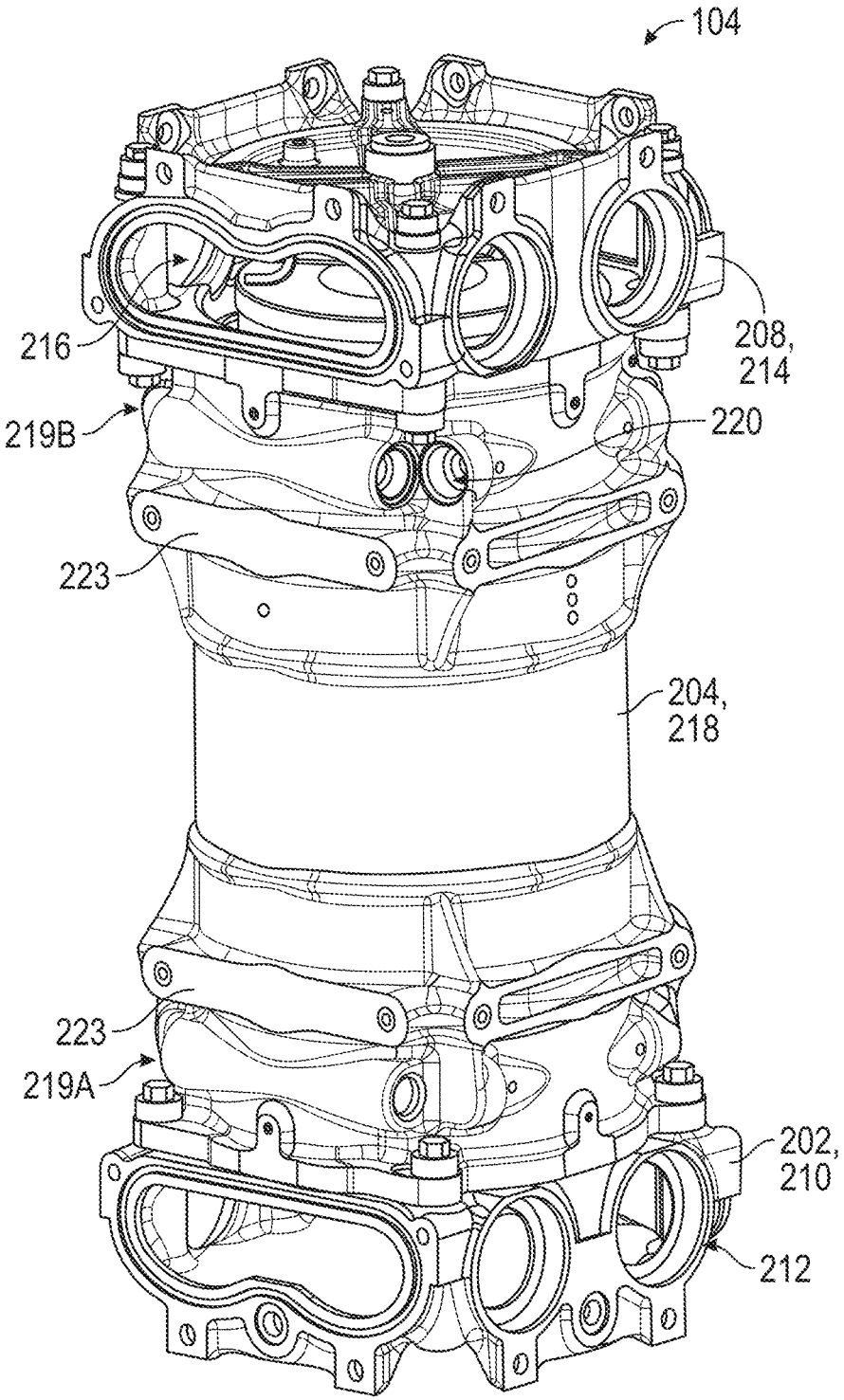
FIG. 2 is a perspective view of the oil separation device according to one example of the present application.
Figure 3:
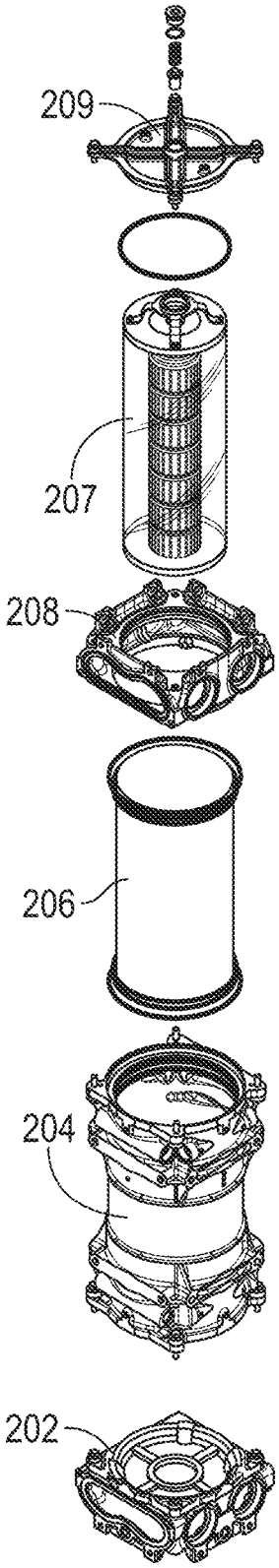
FIG. 3 is an exploded view of components of the oil separation device of FIG. 2.

FIG. 2 shows an example of the oil separation device 104 that can be used with the system 102 described previously. FIG. 3 shows an exploded view of components of the oil separation device 104. As shown in FIG. 3, the oil separation device 104 can include a first cover 202, an outer housing 204, an inner housing 206, a coalescing filter 207, a second cover 208 and a filter access end cover 209.

Referring now to FIG. 2, the first cover 202 can have an open frame construction with an interior plenum, cavity or manifold (not numbered) and can include a main body 210 and one or more ports 212. As shown in FIG. 2, the second cover 208 can have an open frame construction with an interior plenum, cavity or manifold (not numbered) and can include a main body 214 and one or more ports 216. Selective of the one or more ports 212 and/or one or more ports 216 can be blocked from receiving or outleting blow-by gas with a cover, plug, plate or other feature to close the respective port according to some examples.

As shown in FIG. 2, the first cover 202 can be connected to a first end portion 219A of the outer housing 204 by fastener, weld, solder, threading or other mechanical connection as known in the art. Similarly, the second cover 208 can be connected to a second end portion 219B of the outer housing 204 in a similar manner to the first cover 202. The second end portion 219B can generally oppose the first end portion 219A.

The first cover 202 and/or the second cover 208 can be part of the outer housing 204 according to further examples rather than being a separate component. For example, the outer housing 204, the first cover 202 and/or the second cover 208 could comprise an integral single piece assembly according to some examples. The present application can refer to the first cover 202 and the second cover 208, the cover and other components as a "housing" for simplicity herein with the understanding that the term housing as used herein broadly refers to not just the inner housing 206 and outer housing 204 but also the first cover 202, the second cover 208, the filter access end cover 209 and/or other components that are not the coalescing filter 207. Similarly, terms like "upper", "lower", "top", "bottom" are relative terms not absolute terms. The orientation of the oil separation device 104 can vary from the exemplary orientation illustrated.

The first cover 202 and the second cover 208 can have a square, rectangular, circular, pentagon, quadrilateral, hexagon, octagon, or other shape in cross-section as desired and can be constructed of any suitable material(s). The main body 210 can form exterior walls, faces, one or more manifolds, cavities or plenums and other features of the first cover 202. In brief, the main body 210 can be configured to form the one or more ports 212 for communication of blow-by gas into or out of the oil separation device 104. Although not specifically shown, an insulative material can abut or be in close proximity to and extend over one or more sides of the main body 210 such as at an end thereof. The insulative material can be held in place with mechanical fasteners, a plate and/or other feature or components. According to one example, the insulative material can be a fiberglass insulation encapsulated within a stainless steel foil, or a steel outer shell with an integral foam insulative underlayer.

The outer housing 204 can have a hollow generally tubular shape, for example. This shape can form an inner cavity configured to receive the inner housing 206 (FIG. 3). Thus, the inner housing 206 can be positioned within the outer housing 204. The inner housing 206 and the outer housing 204 can be constructed of suitable material(s). Although the outer housing 204 and the inner housing 206 are illustrated as separate components in the FIGURES, it is contemplated in some examples that these could be integrally formed as a single piece such as by casting or another forming technique. Referring to FIG. 2, the outer housing 204 can form a wall 218 with ports 220 passing through the wall 218. These ports 220 can provide inlet(s) or outlet(s) as desired and can be in fluid communication with a jacket 222 (discussed and illustrated further in FIG. 5A and other of the FIGURES). The ports 220 can be located adjacent specifically configured flanges 223 or other features of the outer housing 204. The flanges 223 can form different generally planar faces of the outer housing 204. These faces of the outer housing 204 can correspond with faces of the first cover 202 and/or the second cover 208, for example.

Turning to the second cover 208, the main body 214 can form exterior walls, faces, one or more manifolds, cavities, plenums and other features of the second cover 208. The main body 214 can be configured to form the one or more ports 216 for communication of blow-by gas into or out of the oil separation device 104. The filter access end cover 209 can be configured to couple with the main body 214 and can be selectively removable therefrom. The filter access end cover 209 (FIG. 3) can allow access to an inner cavity (formed by the inner housing 206) and the coalescing filter 207. The coalescing filter 207 can be removed and changed for a new filter with selective removal of the filter access end cover 209 from the main body 214. An insulative material can abut or be in close proximity to and extend over one or more sides of the main body 214 and the filter access end cover 209. The insulative material can be held in place with mechanical fasteners, a plate and/or other features or components in a manner similar to that if the insulative material of the first cover 202.

The second cover 208 can couple to the outer housing 204 so as to be in close proximity to but spaced from the coalescing filter 207. The inner housing 206 can be positioned within the outer housing 204 (FIG. 3) and can be sealed. The inner housing 206 can comprise a sleeve having a hollow construction forming an inner cavity for receiving the coalescing filter 207.

As shown in FIG. 2, the second cover 208 can form a cavity internally. This cavity can be in fluid communication with the one or more ports 216 for outflow of blow-by gas after being filtered by the coalescing filter 207. The second cover 208, in particular the main body 214, can include a central port that is part of the cavity that allows for passage of the coalescing filter 207 into the inner cavity 240 of the inner housing 206. The filter access end cover 209 can be configured to couple with the main body 214 and can be sealed thereto.

Figure 4A:
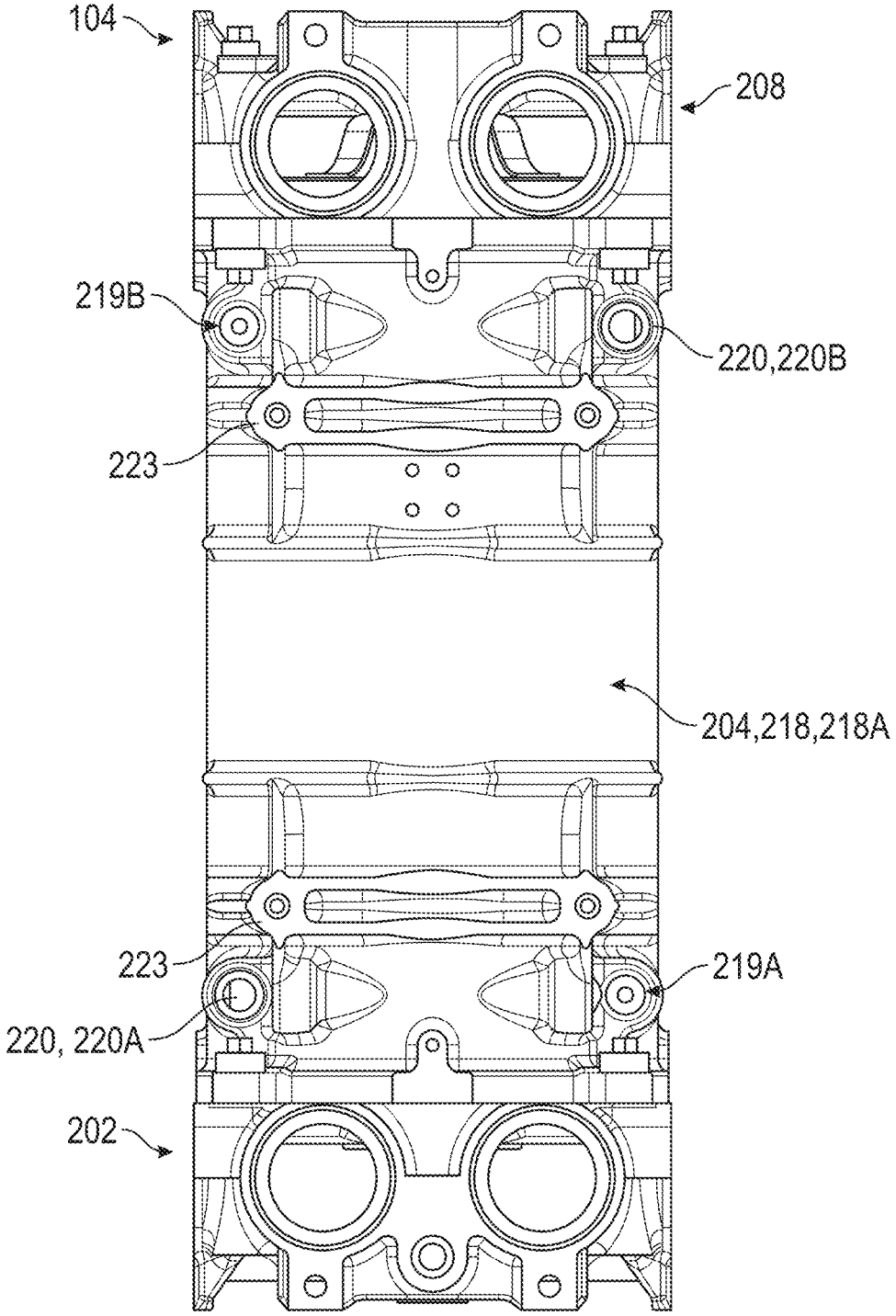
FIG. 4A is a plan view of a first side of the oil separation device of FIGS. 2 and 3 according to one example of the present application.
Figure 4B:
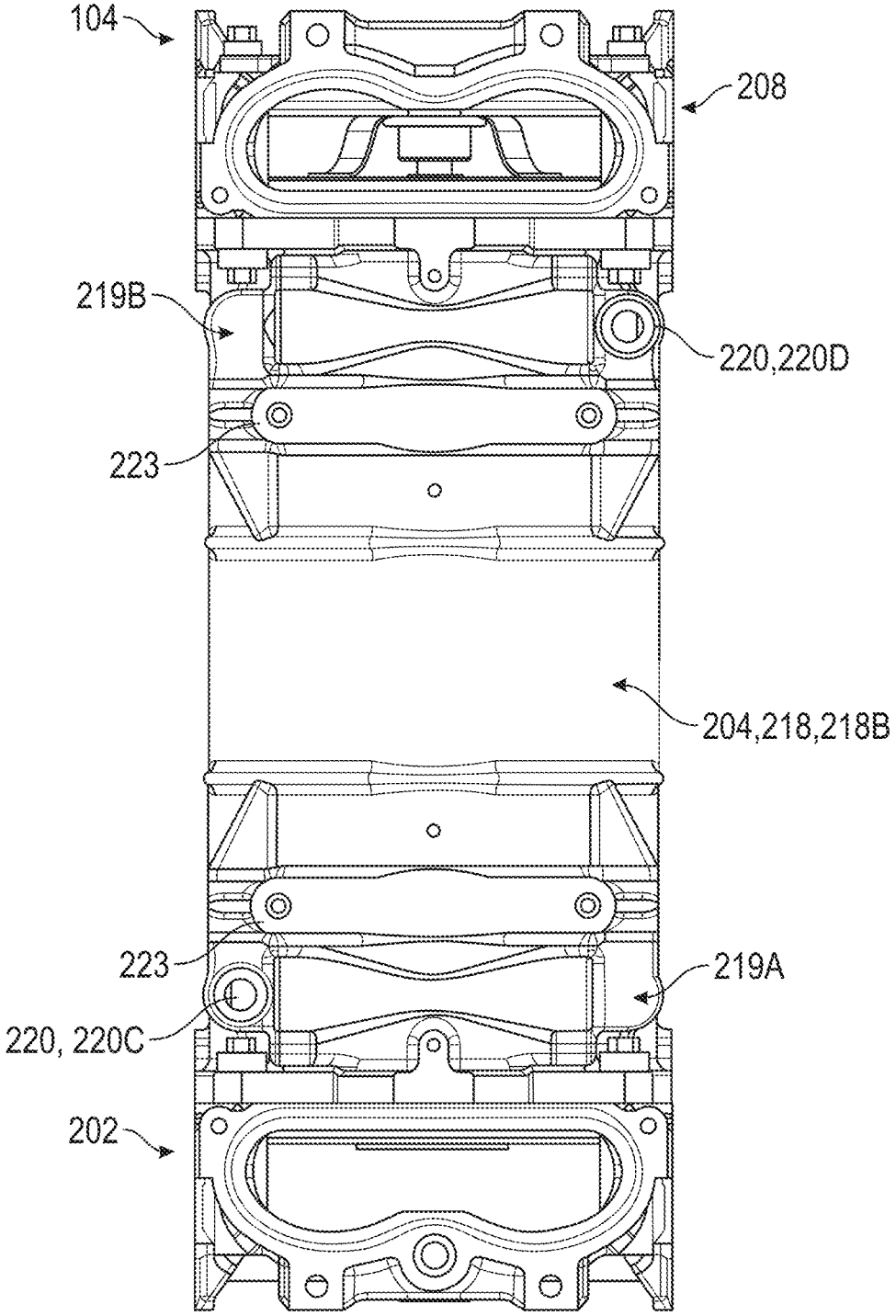
FIG. 4B is a plan view of a second side of the oil separation device of FIGS. 2 and 3 according to one example of the present application.

FIGS. 4A and 4B show plan views of two adjacent sides/faces of the oil separation device 104. FIG. 4A shows a first side 218A of the wall 218 and FIG. 4B shows a second side 218B of the wall 218. FIGS. 4A and 4B additionally show the flanges 223 of the outer housing 204, the first cover 202 and the second cover 208. The outer housing 204 has a plurality of ports 220 as previously discussed allowing for communication through the wall 218 into the jacket 222 (FIG. 5A) formed on an interior of the outer housing 204 between the outer housing 204 and the inner housing 206 (FIG. 3). FIG. 4A shows a first port 220A and a second port 220B of the plurality of ports 220. FIG. 4B shows a third port 220C and a fourth port 220D. It is understood that the outer housing 204 can include additional of the plurality of ports 220 not specifically shown such that the outer housing 204 can include five, six, seven, eight or more ports if desired. Similarly, although four ports are illustrated, less than four ports are contemplated according to some examples. As shown in FIGS. 4A and 4B, the first port 220A and the third port 220C can be located at the first end portion 219A of the outer housing 204 adjacent the first cover 202. The second port 220B and the fourth port 220D can be located at the second end portion 219B of the outer housing 204 adjacent the second cover 208.

Figure 5:
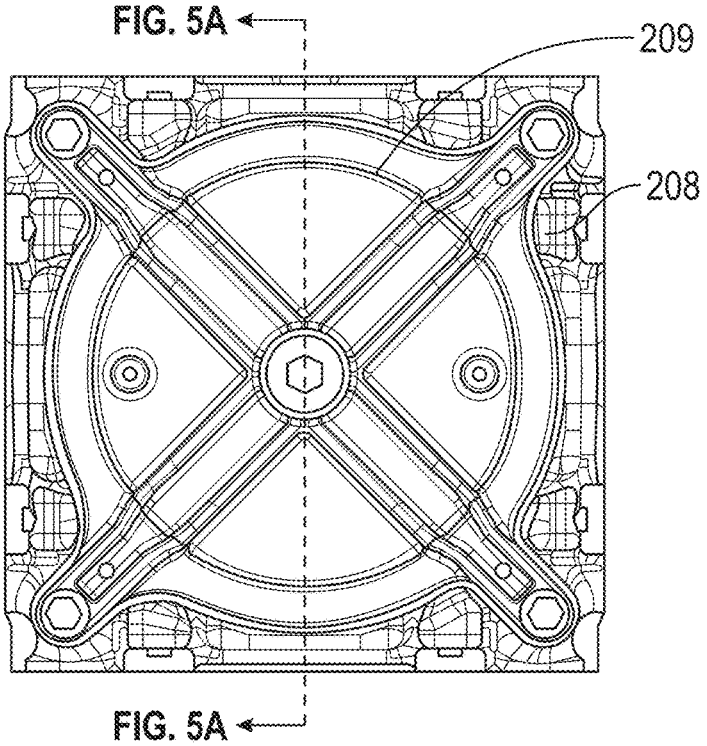
FIG. 5 is a plan view of a second end of the oil separation device of FIGS. 2-4B according to one example of the present application.

FIG. 5 shows a plan view of the second cover 208 and the filter access end cover 209. As shown in FIG. 5, the second cover 208 can have a generally square shape with four faces. However, as discussed previously other shapes for the second cover 208 are contemplated. The filter access end cover 209 can be coupled to the second cover 208 at several locations by fasteners or other known mechanical attachments.

Figure 5A:
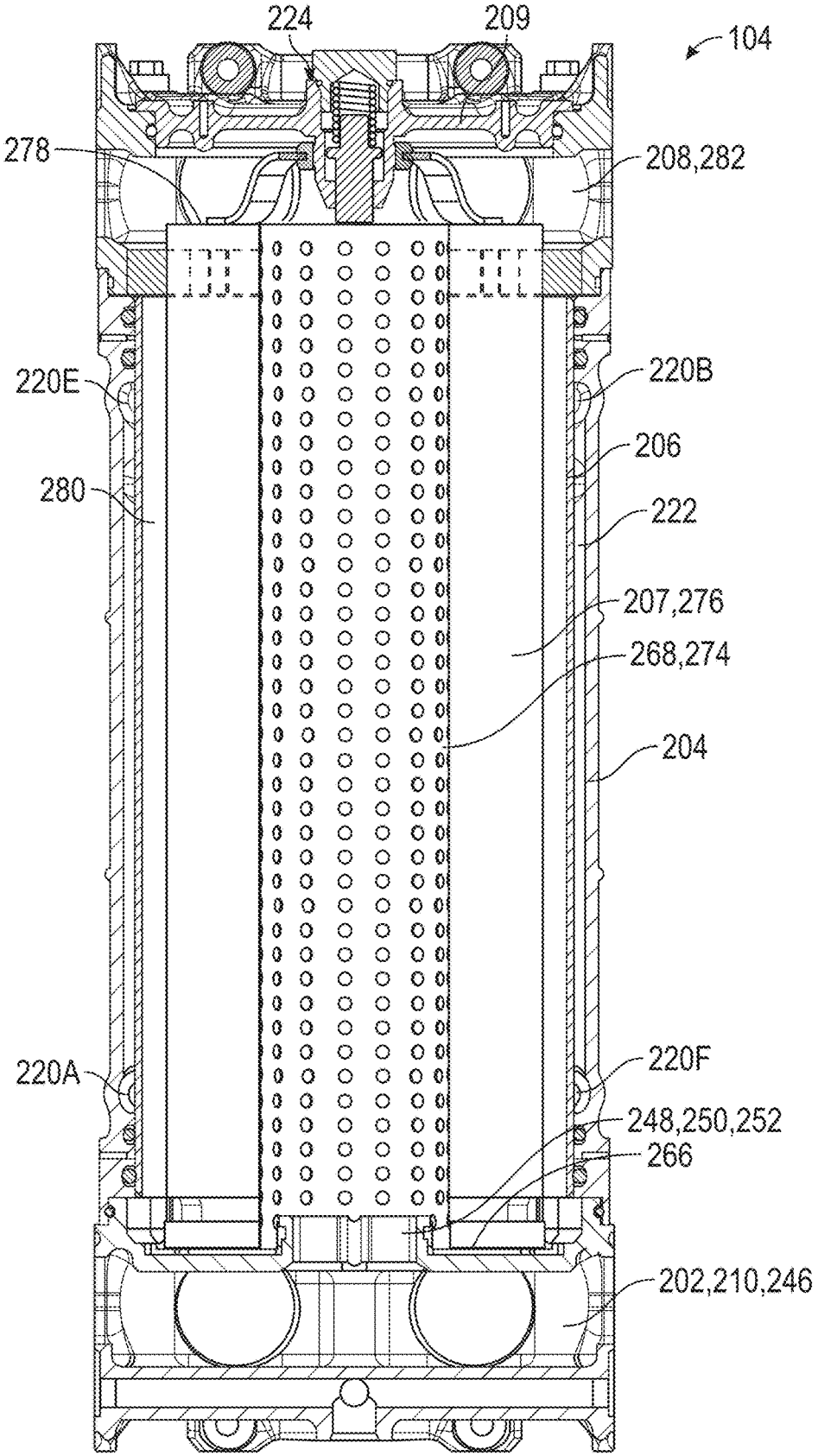
FIG. 5A is a cross-sectional view of the oil separation device of FIG. 5 taken along the line A-A.

FIG. 5A is a cross-sectional view of the oil separation device 104 including the first cover 202, the outer housing 204, the inner housing 206, the coalescing filter 207, the second cover 208, the filter access end cover 209, the jacket 222 and an upper filter support assembly 224.

The first cover 202 can include the main body 210 as discussed previously. The first cover 202 can additionally include a lower cavity 246 and a lower filter support 248. The lower filter support 248 can include a filter interface 250 with a port 252. The lower cavity 246 can be defined by the main body 210 and can have the one or more ports 212 as inlets (or outlets) and the port 252 as an inlet or outlet thereto. The main body 210 can form an upper wall of the first cover 202 and the lower filter support 248 can be positioned along a top of the first cover 202. The filter interface 250 can be a centralized projection extending above the upper wall of the main body 210. The filter interface 250 can form the port.

FIG. 5A shows the lower portion of the coalescing filter 207 including a lower end cap 266. The first cover 202 is configured to allow for fluid communication between the lower cavity 246 and a central cavity 268 of the coalescing filter 207. In particular, blow-by gas can enter the lower cavity 246 from any direction via the one or more ports 212 (FIG. 2) defined by the main body 210. The blow-by gas can pass from the lower cavity 246 through the lower filter support 248 via the port to the coalescing filter 207. The central cavity 268 can be circular or non-circular in cross-section. The central cavity 268 can be defined by the core 274. The coalescing filter 207 can have a generally cylindrical shape about the central cavity 268 and the core 274. The core 274 can be positioned within the filter media 276. The core 274 can comprise a thin formed cylindrical sheet having a plurality of apertures therein. These apertures communicate with the filter media 276. The coalescing filter 207 is configured to separate a portion of the oil contained in the blow-by gas. The coalescing filter 207 can be constructed using a single or multi-layer synthetic micro-glass fiber, synthetic fiber, or other coalescing filter media types known in the industry with the filter media 276 formed into a tube shape, wound around the core 274, or pleated and located around the core 274. The filter media 276 can be configured for coalescing of oil from oil mist of the blow-by gas. In addition to the filter media 276, the coalescing filter 207 can also include end caps such as the lower end cap 266 and an upper end cap 278. The end caps 266, 278 can be constructed of a thin sheet of rigid material that is bonded or otherwise coupled to the core 274 and/or the filter media 276. The material can be metal, metal alloy(s), suitable rigid and stable polymer or composites thereof. The coalescing filter 207 can be sealed to the overall housing with suitable associated seals. However, in some examples, the seal(s) are not provided pre-coupled to the coalescing filter 207 but are rather separate components insertable in the housing or are components of the housing. The core 274 and the filter media 276 can have an inner and outer perforated tube structure to provide the axial, torsional, and bending stiffness required for the application. Such stiffness can be reinforced by the end caps.

The jacket 222 can comprise a sealed (from the inner cavity, the blow-by gas, oil and from the coalescing filter 207) cavity formed between an interior side of the wall 218 of the outer housing 204 and an outer surface of the inner housing 206. Thus, the jacket 222 can be formed between the inner housing 206 and the outer housing 204. The jacket 222 can be cylindrically shaped having only the ports 220 for fluid communication. The jacket 222 can be configured to receive one or more of an electrical heater coil, an insulative material, a sealed air gap, or a positive mass flow of pressurized engine boost air, engine coolant, or engine lube oil. More particularly, electrically resistive heating coils can be placed in the jacket 222 so as to provide heating to the inner housing 206 and the coalescing filter 207. This can be useful if the oil separation device 104 is being operated in a cold environment. Alternatively or additionally, insulative material such as foam or the like can be placed in the jacket 222 to provide for insulation of the coalescing filter 207 (and blow-by gas) from a harsh environment. The jacket 222 can also receive in addition or alternative to the heating coil and/or insulation, a fluid that can be used for heating or cooling the coalescing filter 207 (and the blow-by gas). Such fluid can be a heating fluid or a cooling fluid, for example. The fluid can be anyone or combination of a sealed air gap, or a positive mass flow of pressurized engine boost air, engine coolant, or engine lube oil, for example. However, the fluid is not limited to these examples. The fluid can be communicated to or from the jacket 222 via the plurality of ports 220. FIG. 5A further shows some of the plurality of ports 220 including the first port 220A and the second port 220B communicating with the jacket 222 in a general tangentially direction. FIG. 5A further shows a fifth port 220E and a sixth port 220F communicating with the jacket 222 generally tangentially. The third port 220C (FIG. 4B) the fourth port 220D (FIG. 4B) are not illustrated in FIG. 5A due to the cross-section selected.

In operations, the first cover 202 can receive blow-by gas containing oil. This blow-by gas can be passed through the filter interface 250 and into the coalescing filter 207 as previously discussed. The blow-by gas containing oil can pass radially outward through the coalescing filter 207 to an outer circumference thereof. During such passage, the configuration of the coalescing filter 207 can cause coalescing of the oil from the blow-by gas. Such coalescing can result in separation of the oil from the blow-by gas. The oil once coalesced can travel to the outer circumference of the coalescing filter 207 and can pass to an outer cavity 280 surrounding the outer circumference of the coalescing filter 207. The blow-by gas that is separated from the oil by action of the coalescing filter 207 can pass from the coalescing filter 207 into the outer cavity 280 and can pass from the outer cavity 280 into the second cover 208 and be received in a cavity 282. The outer cavity 280 can communicate with the second cover 208 around substantially all (100% or 360 degrees), most (60%-99%), a majority (50%-59%), some (25%-49% or part (5%-24%) of the outer circumference of the coalescing filter 207. One or more passages can drain oil from the outer cavity 280 into the first cover 202. The one or more passages can be at least partially formed by the main body 210 of the first cover 202. The one or more passages can have an outlet port(s). This outlet port(s) can be located on one or more of the faces of the main body 210. The one or more passages can be configured to receive the oil captured (separated by action of) by the coalescing filter 207 and can pass the oil as a drainage out of the oil separation device 104 at the outlet port(s). Further discussion of the operation and construction of the oil separation device 104 can be found in U.S. application Ser. No. 18/519,582, Entitled "CRANKCASE OIL SEPARATION DEVICE FOR INTERNAL COMBUSTION ENGINE", filed Nov. 27, 2023, and U.S. application Ser. No. 18/092,525, entitled "MODULAR ASSEMBLIES FOR CRANKCASE OIL SEPARATORS", filed Jan. 3, 2023, the entire specifications of each of which is incorporated herein by reference.

Figure 6:
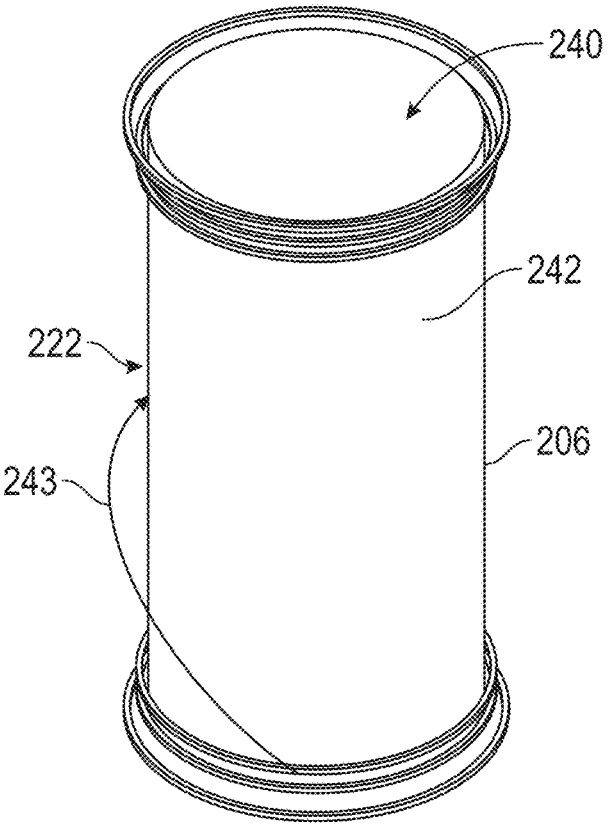
FIG. 6 is a perspective view of an inner housing of the oil separation device of FIGS. 2-5A and further illustrating a direction of a flow of a fluid through a jacket that is adjacent and partially formed by an outer surface of the inner housing according to one example of the present application.

FIG. 6 is a perspective view of the inner housing 206 having an inner cavity 240 and an outer surface 242. The inner housing 206 is generally cylindrical and tubular in shape as previously described forming the inner cavity 240 that receives the coalescing filter (see FIG. 5A for example). Ends of the inner housing 206 can be provided with flanges, recesses or other sealing features, for example. The outer surface 242 can be generally cylindrical in shape. FIG. 6 additionally illustrates a path 243 of a flow of the fluid through the jacket 222 along the outer surface 242 of the inner cavity 240. The flow as shown by the path 243 can be a spiral or partial spiral that passes the fluid along the outer surface 242 and along an elongate length of the inner housing 206.

Figure 7:
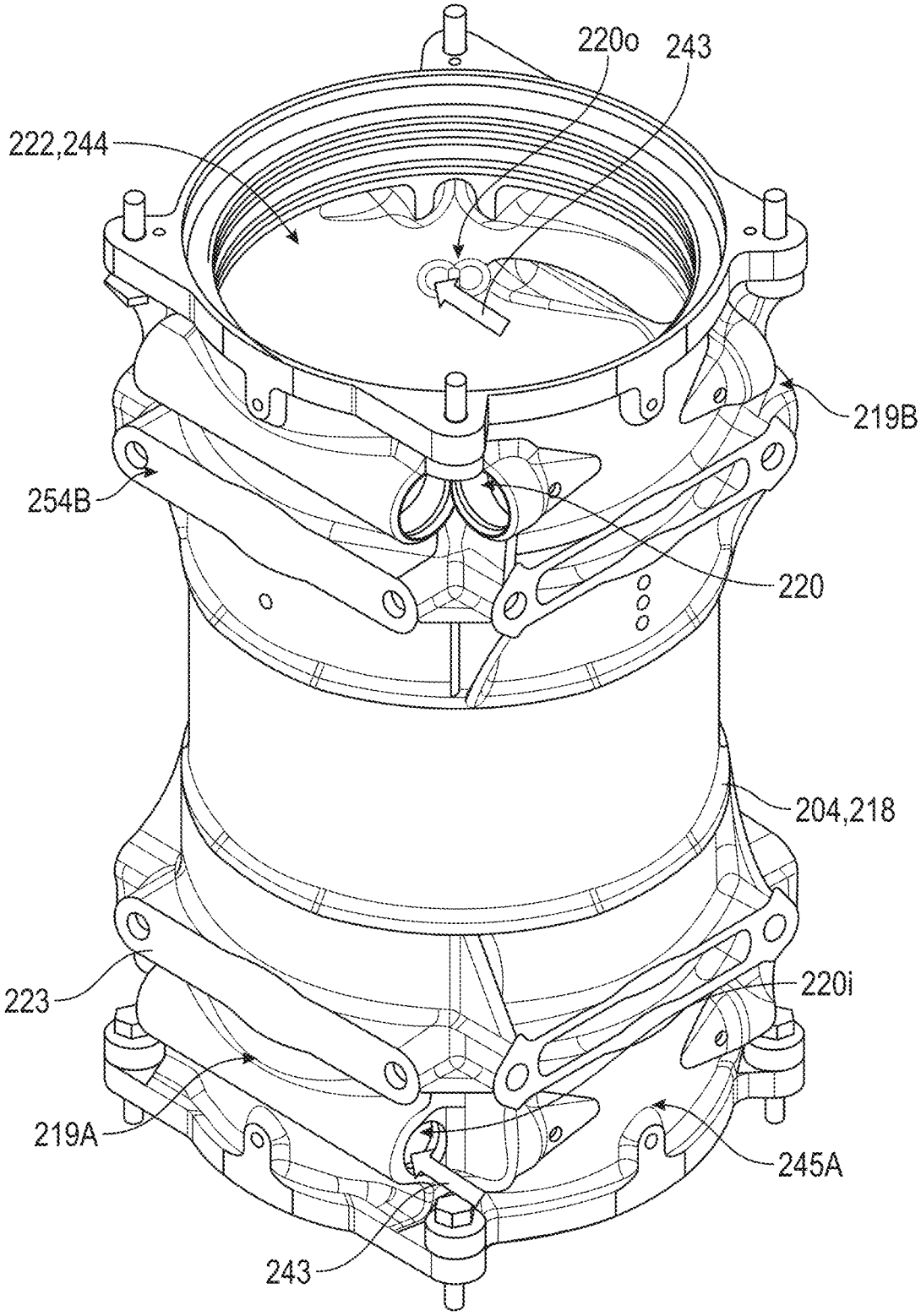
FIG. 7 is a perspective view of an outer housing of the oil separation device of FIGS. 2-5A and further illustrating a direction of the flow of the fluid of FIG. 6 into the jacket via a first inlet port and out of the jacket via a first outlet port according to one example of the present application.

FIG. 7 is a perspective view of the outer housing 204 including the wall 218, the flanges 223, the plurality of ports 220 and a cavity 244. The outer housing 204 can be generally tubular in shape and is configured to receive the receive the inner housing 206 (FIG. 6) therein via the cavity 244. A portion of the cavity 244 forms the jacket 222 once the inner housing 206 (FIG. 6) is inserted into the cavity 244.

FIG. 7 illustrates the path 243 of the fluid into a first inlet port 220*i* of the outer housing 204, through the jacket 222 to and through a first outlet port 220*o*. The first inlet port 220*i* can extend generally tangentially to the jacket 222. Similarly, the first outlet port 220*o* can extend generally tangentially to the jacket 222. The first inlet port 220*i* can have an opening at a first face 245A of the outer housing 204. The first outlet port 220*o* can have an opening at a second face 245B of the outer housing 204. This second face 245B can be on an opposing side of the outer housing 204 as shown in FIG. 7 or can be on a face that is generally orthogonal to the first face 245A.

The first inlet port 220*i* can be located at or adjacent the first end portion 219A. The first outlet port 220*o* can be located at or adjacent the second end portion 219B. Thus, the first inlet port 220*i* can be located at a first of the first end portion 219A or the second end portion 219B of the outer housing 204. The first outlet port 220*o* can be located at a second of the first end portion 219A or the second end portion 219B opposite from the first inlet port 220*i*. As shown in FIG. 7 by the path 243 and the locations of the first inlet port 220*i* and the first outlet port 220*o*, the fluid can be imparted with a rotation moving along the jacket 222 and can move along the elongate length of the jacket 222 from the first inlet port 220*i* to the first outlet port 220*o*.

The first inlet port 220*i* and the first outlet port 220*o* can be some of the plurality of ports 220 discussed previously. Others of the plurality of ports 220 can be sealed so as not to be utilized for fluid inflow or outflow according to examples of the present application. However, some or all of the plurality of ports 220 can be selectively utilized for fluid inflow or fluid outflow according to further examples.

As shown in FIG. 7, the jacket 222 is configured to receive the flow of the fluid therein via the first inlet port 220*i* and circulate the fluid from the first inlet port around at least a portion of the outer surface 242 (FIG. 6) of the inner housing 206 (FIG. 6) to the first outlet port 220*o*. To circulate the flow of the fluid, the first inlet port 220*i*, the jacket 222 and the first outlet port 220*o* are configured to impart a rotation to the flow of the fluid that passes the fluid along the outer surface 242 (FIG. 6) and along an elongate length of the inner housing 206 (FIG. 6). This rotation can be accomplished by the generally tangential arrangement of the first inlet port 220*i* and the first outlet port 220*o* relative to the jacket 222 and by the generally cylindrical extend of the jacket 222. Put another way, the first inlet port 220*i* is configured to communicate with the jacket 222 to introduce the flow of the fluid into the jacket 222 in a first direction (indicated with arrow) that is generally tangential to the jacket 222 and the first outlet port 220*o* is configured to communicate with the jacket 222 to route the flow of the fluid from the jacket 222 in the first direction or an orthogonal direction to the first direction that is generally tangential to the jacket 222. As shown in FIG. 7, the first inlet port 220*i* is located at a first tangential corner of the jacket 222 and the first outlet port 220*o* is located at a second tangential corner of the jacket 222. The first tangential corner is opposite from the second tangential corner (on opposite ends and opposite corners of the jacket 222 as shown in FIG. 7).

Figure 8A:
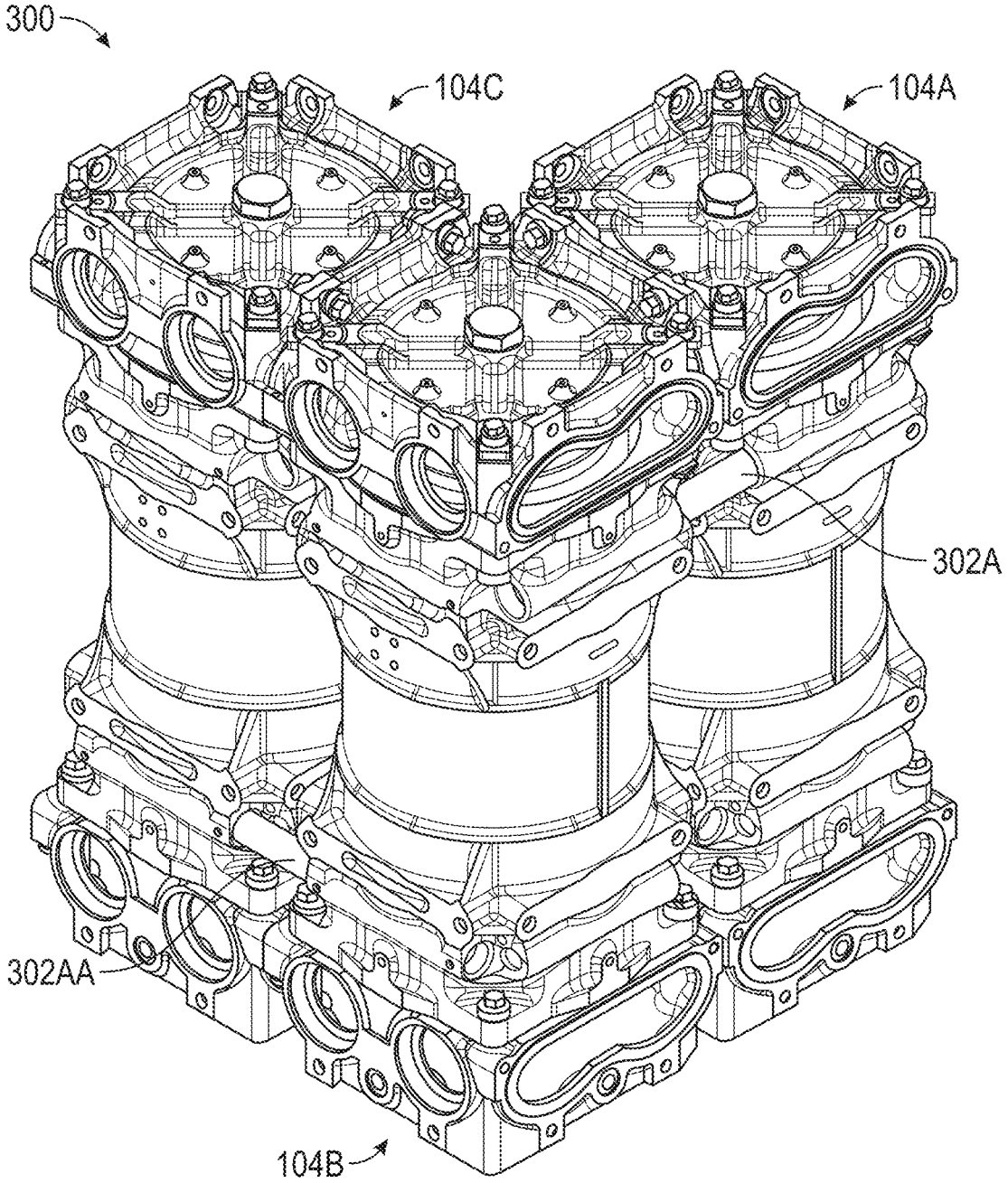
FIG. 8A is a first perspective view of an assembly of the plurality of oil separation devices arranged in an L-shaped array according to one example of the present application.
Figure 8B:
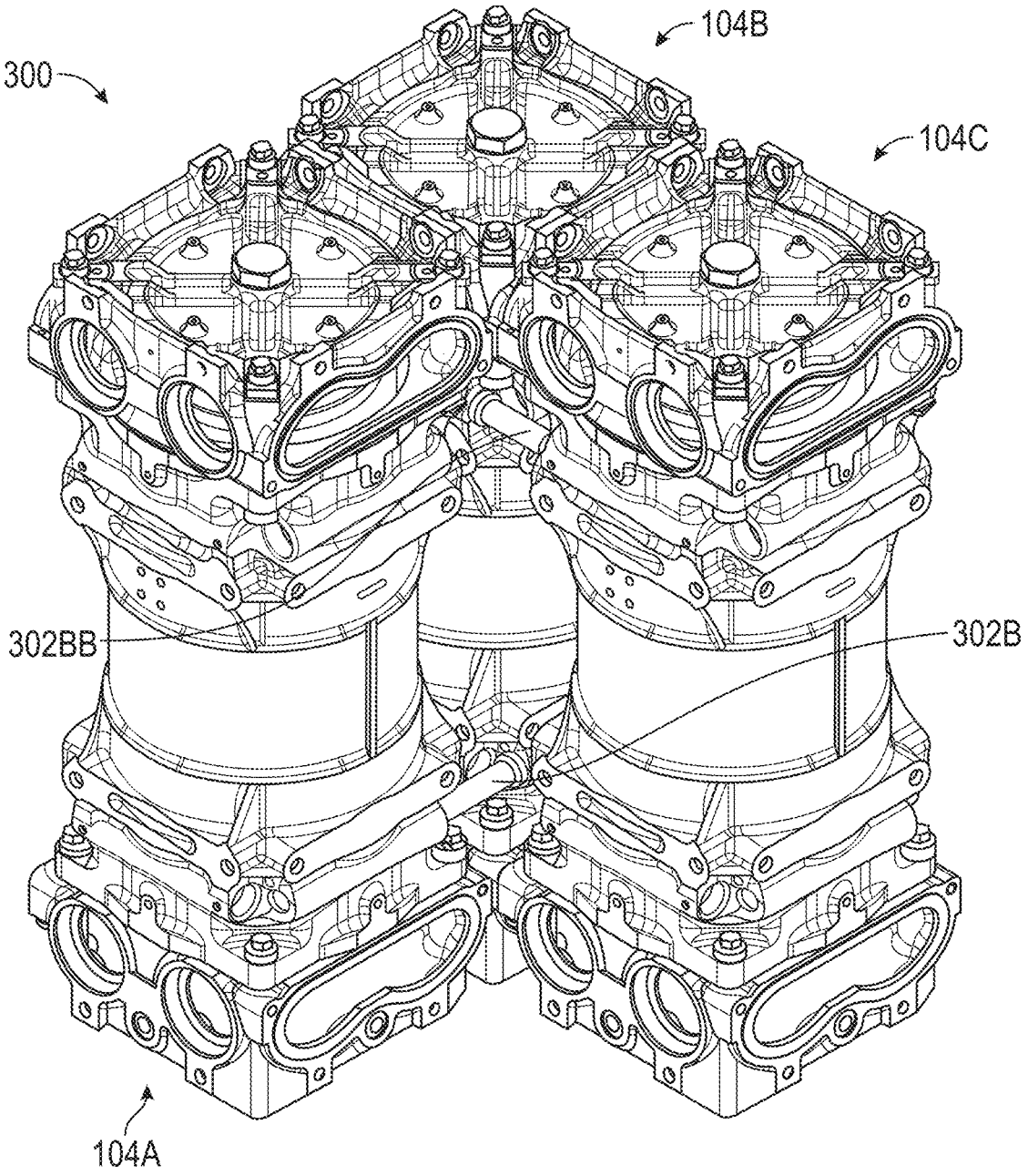
FIG. 8B is a second perspective view of the assembly of FIG. 8A.

FIGS. 8A and 8B provide different perspective views of an assembly 300 of a plurality of the oil separation devices including a first oil separation device 104A, a second oil separation device 104B and a third oil separation device 104C. The first oil separation device 104A, the second oil separation device 104B and the third oil separation device 104C can be of identical construction to the oil separation device previously described herein.

The assembly 300 can include a plurality of jumper tubes as further described and illustrated. The plurality of jumper tubes include first jumper tubes 302A and 302AA as shown in FIG. 8A and second jumper tubes 302B and 302BB as shown in FIG. 8B. The construction of the first jumper tubes 302A and 302AA differs from the construction of the second jumper tubes 302B and 302BB.

As shown in FIGS. 8A and 8B, the first oil separation device 104A, the second oil separation device 104B and the third oil separation device 104C are physically coupled together as an L-shaped array. More specifically, the first oil separation device 104A is coupled to the second oil separation device 104B such as via the flanges 223 (FIG. 2) and fasteners and other coupling features and components of the faces of the first cover 202 (FIG. 2) and the second cover 208 (FIG. 2). The second oil separation device 104B can be coupled to the third oil separation device 104C using different faces thereof.

FIG. 8A shows the first jumper tube 302A extending between the first oil separation device 104A and the second oil separation device 104B. The first jumper tube 302A allows the jacket of the first oil separation device 104A to be in fluid communication with a second jacket of the second oil separation device 104B. The first jumper tube 302AA extends between the second oil separation device 104B and the third oil separation device 104C. The first jumper tube 302AA allows the second jacket of the second oil separation device 104B to be in fluid communication with a third jacket of the third oil separation device 104C. As shown in FIG. 8A, the first jumper tube 302A is positioned to be received in ports of the first oil separation device 104A and the second oil separation device 104B that are at the second end portion thereof. In contrast, the first jumper tube 302AA is positioned to be received in ports of the second oil separation device 104B and the third oil separation device 104C that are on the first end portion thereof.

FIG. 8B shows the shows the second jumper tube 302B extending between the first oil separation device 104A and the second oil separation device 104B. The second jumper tube 302B allows the jacket of the first oil separation device 104A to be in fluid communication with a second jacket of the second oil separation device 104B. The second jumper tube 302BB extends between the second oil separation device 104B and the third oil separation device 104C. The second jumper tube 302BB allows the second jacket of the second oil separation device 104B to be in fluid communication with a third jacket of the third oil separation device 104C. As shown in FIG. 8B, the second jumper tube 302B is positioned to be received in ports of the first oil separation device 104A and the second oil separation device 104B that are at the first end portion thereof. In contrast, the second jumper tube 302BB is positioned to be received in ports of the second oil separation device 104B and the third oil separation device 104C that are on the second end portion thereof.

Although and L-shaped array for assembly 300 is illustrated, the present oil separation devices can be arranged in various configurations that can maintain common inlet and/or outlet covers and cavities with a wide variety of coalescing filter lengths (the central housing between the inlet and outlet covers can be removed and replaced with different length as desired). Additionally, the configuration of the inlet and/or outlet covers having ports/passages on each of four faces (or even three of four faces) allows for various system configurations (single row arrays, multi-row parallel arrays, multi-row series arrays, U-shaped arrays, L-shape arrays, T-shaped arrays, H-shaped arrays, single row arrays, etc.). Because the outer housing 204 (FIG. 2) can also include the plurality of ports 220 (FIG. 2) as variously show and discussed, fluid can be communicated between jackets in various flow paths. The plurality of ports 220 (FIG. 2) can be located along multiple sides/faces (e.g., corresponding to the four faces of the inlet and/or outlet covers, for example). This can allow for supplemental energy fluid to be supplied between the oil separation devices in various directions as desired. The configuration of the inlet and/or outlet covers having ports/passages on each of four faces (or even three of four faces) minimizes or eliminates the need for piping, lines or other communication mechanisms between the oil separation devices of the system. Put another way, the configuration of the oil separation devices allows for them to be placed in close proximity (e.g., abutting or spaced a small distance) communicating with one another as desired and allows for blow-by, oil drain, supplemental energy to the jacket to be communicated between the oil separation devices as desired.

Figure 9A:
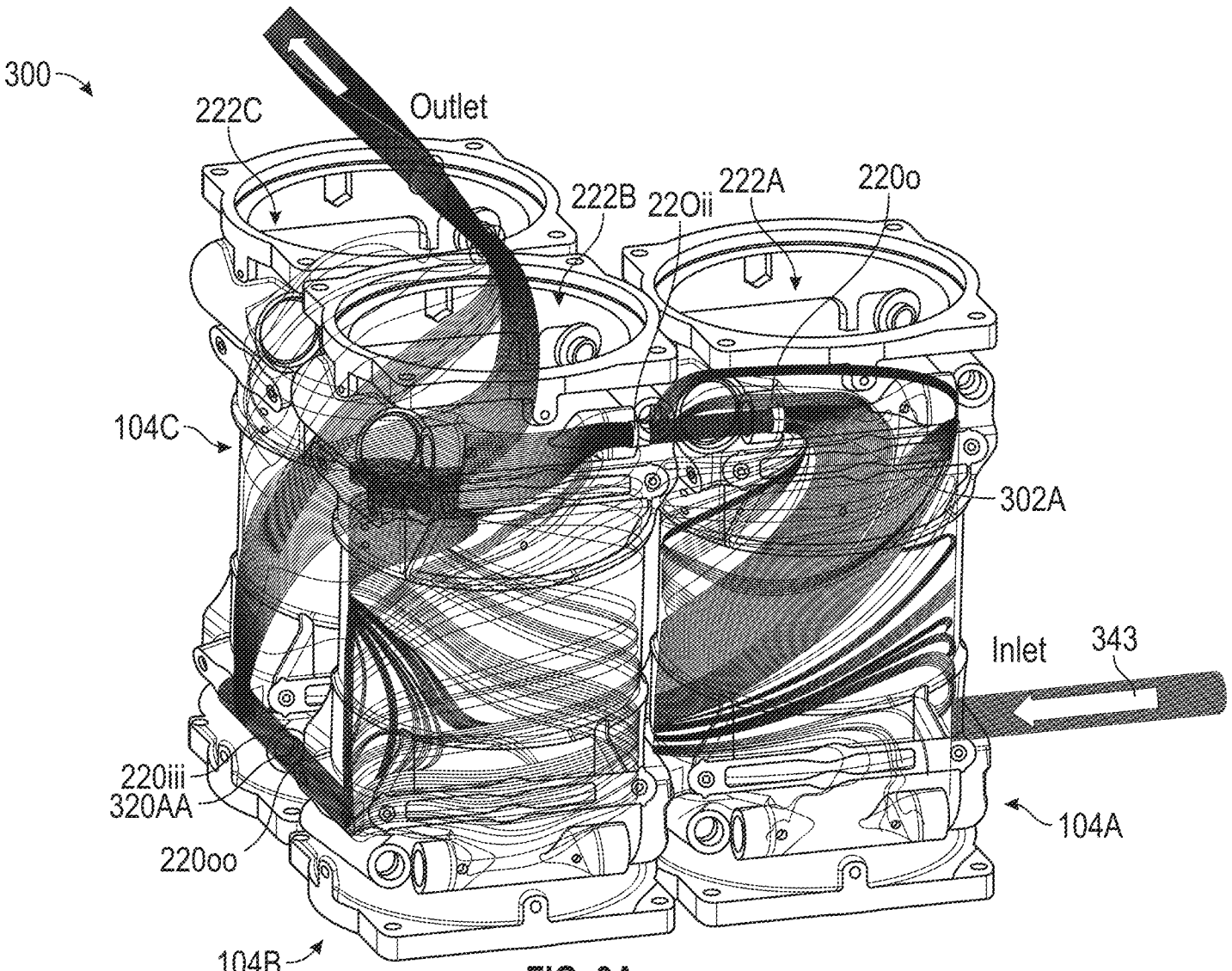
FIG. 9A is a first schematic view of the assembly of FIG. 8A illustrating a flow path of the flow of the fluid through a first jacket, a second jacket and a third jacket of a first oil separation device, a second oil separation device and a third oil separation device, respectively, according to one example of the present application.
Figure 9B:
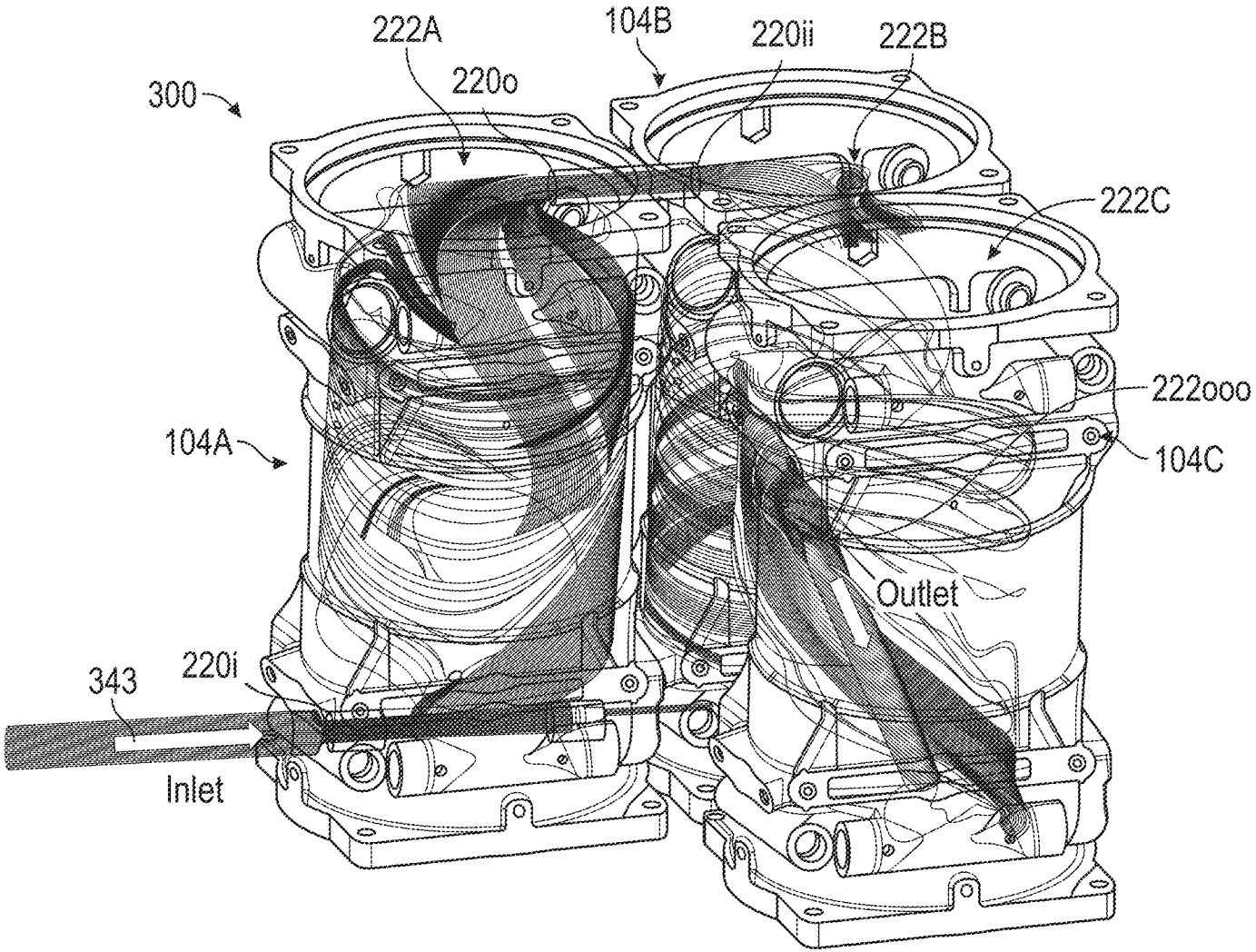
FIG. 9B is a second schematic view of the assembly of FIGS. 8A, 8B an 9A from a different perspective illustrating the flow path of the flow of the fluid through the first jacket, the second jacket and the third jacket of the first oil separation device, the second oil separation device and the third oil separation device, respectively.

FIGS. 9A and 9B show a schematic modeling the path 343 of flow through the assembly 300 of the first oil separation device 104A, the second oil separation device 104B and the third oil separation device 104C.

As shown in FIGS. 9A and 9B, the first oil separating apparatus 104A is illustrated and includes a first jacket 222A, the second oil separating apparatus 104B includes a second jacket 222B and the third oil separating apparatus 104C includes a third jacket 222C. The first jacket 222A is in fluid communication with the second jacket 222B via the first jumper tube 302A (FIG. 9A). The second jacket 222B is in fluid communication with the third jacket via the first jumper tube 302AA (FIG. 9A).

Additionally, as shown variously in FIGS. 9A and 9B, via a first inlet port 220*i* (FIG. 9B), the first jacket 222A receives a fluid (indicated with arrow) flowing in a generally tangential direction relative to the first jacket 222A upon entry. The generally tangential positioning of the first inlet port 220*i* (FIG. 9B) relative to the first jacket 222A circulates the fluid from the first inlet port 220*i* around at least a portion of the first jacket 222A to a first outlet port 220*o* communicating with the first jumper tube 302A (FIG. 9A). As shown, the first outlet port 220*o* and the first jumper tube 302A (FIG. 9A) are positioned to extend generally tangentially relative to the first jacket 222A. Similarly, the via a second inlet port 220*ii*, the second jacket 222B receives the fluid via the first jumper tube 302A with the fluid flowing in a generally tangential direction relative to the second jacket 222B upon entry. The generally tangential positioning of the second inlet port 220*ii* relative to the second jacket 222B circulates the fluid from the second inlet port 220*ii* around at least a portion of the second jacket 222B to a second outlet port 220*oo* (FIG. 9A) communicating with the first jumper tube 302AA (FIG. 9A). As shown in FIG. 9A, the second outlet port 220*oo* and the first jumper tube 302AA are positioned to extend generally tangentially relative to the second jacket 222B.

Via a third inlet port 220*iii* shown in FIG. 9A, the third jacket 222C receives the fluid via the first jumper tube 302AA with the fluid flowing in a generally tangential direction relative to the third jacket 222C upon entry. The generally tangential positioning of the third inlet port 220*iii* relative to the third jacket 222C circulates the fluid from the third inlet port 220*iii* around at least a portion of the third jacket 222C to a third outlet port 220*ooo* (FIG. 9B). As shown in FIG. 9B, the third outlet port 220*ooo* is positioned to extend generally tangentially relative to the third jacket 222C.

As shown in FIG. 9B, the first inlet port 220*i* is located at a first tangential corner of the first jacket 222A and the first outlet port 220*o* is located at a second tangential corner of the first jacket 222A. The first tangential corner is opposite from the second tangential corner (on opposite ends and opposite corners of the first jacket 222A as shown in FIG. 9B). FIGS. 9A and 9B show the circulation of the fluid along the path 343 through the first jacket 222A, the second jacket 222B and the third jacket 222C. This path 343 can be rotational with respect to a centerline axis of each of the first oil separation device 104A, the second oil separation device 104B and the third oil separation device 104C having a spiral or partial spiral shape when passing through the first jacket 222A, the second jacket 222B and the third jacket 222C.

Figure 10:
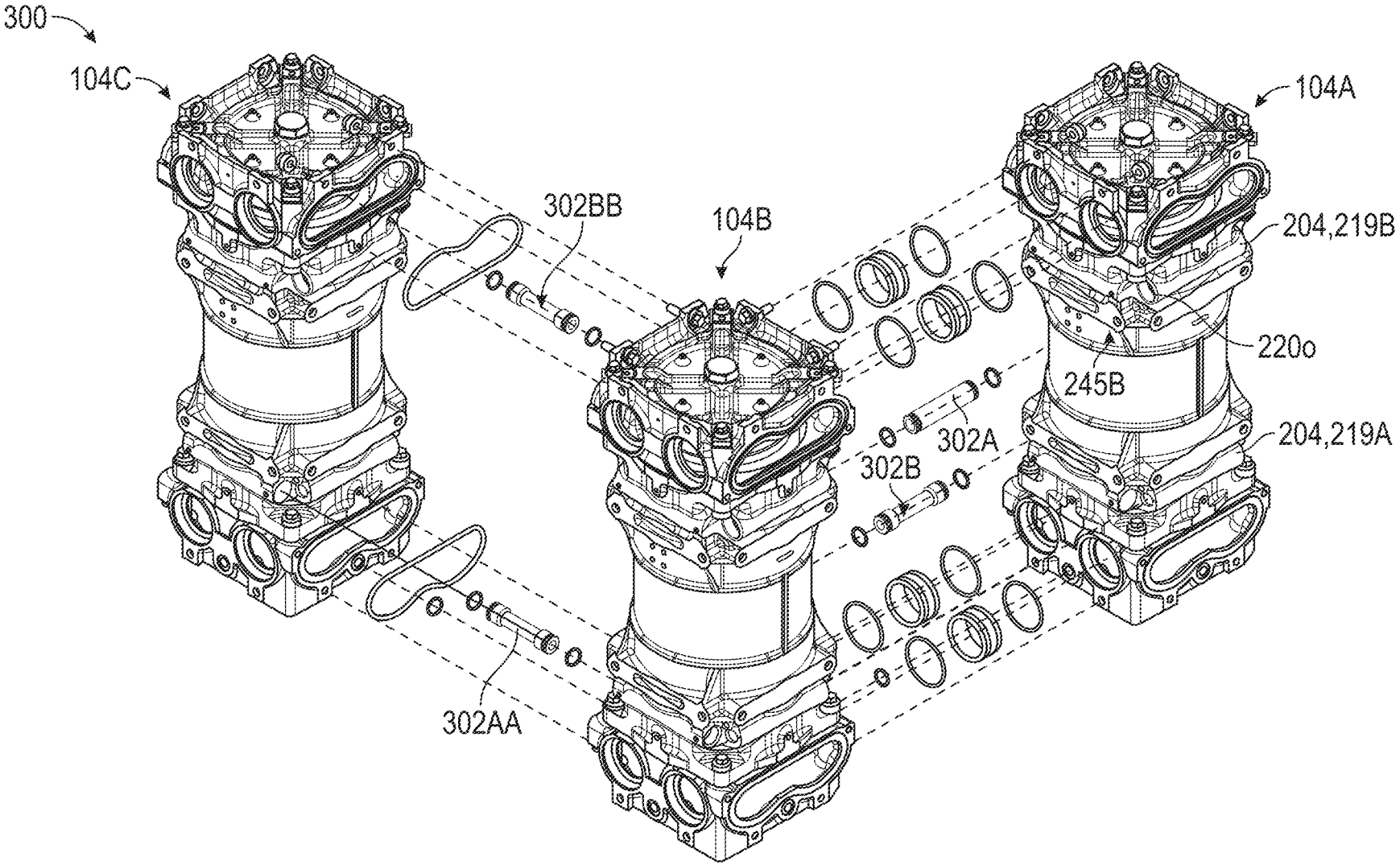
FIG. 10 is an exploded view of the assembly of FIGS. 8A and 8B illustrating the various components of the assembly including a plurality of jumper tubes according to one example of the present application.

FIG. 10 is an exploded view of the assembly 300 from the orientation of FIG. 8A. FIG. 10 illustrates various sealing and adapter components in addition to the first oil separation device 104A, the second oil separation device 104B, the third oil separation device 104C, the first jumper tube 302A, the first jumper tube 302AA, the second jumper tube 302B and the second jumper tube 302BB.

As shown in FIG. 10, the second jumper tubes 302B and 302BB can have a construction that differs from a construction of the first jumper tubes 302A and 302AA. While the first jumper tubes 302A and 302AA are coupled to the outlet and inlet ports as described and illustrated previously, the second jumper tube 302B is coupled to a port 320A (not shown in FIG. 10 but shown in FIG. 11A) of the first oil separation device 104A and is coupled to a port 320B (see FIG. 11A) of the second oil separation device 104B. Similarly, the second jumper tube 302BB is coupled to a port 320C (now shown in FIG. 10 but shown in FIG. 11B) of the second oil separation device 104B and to a port 320D (see FIG. 11B) of the third oil separation device 104C. The second jumper tubes 302B and 302BB do not form a main flow path between the jackets of the first oil separation device 104A, the second oil separation device 104B and the third oil separation device 104C but are rather used for servicing and setup of the assembly 300 as further discussed subsequently. As shown in FIG. 10, the first outlet port 220*o* has an opening at the second face 245B of the outer housing 204. The first outlet port 220*o* is located at a one of the first end portion 219A or the second end portion 219B of the outer housing 204 opposite from the port 320A (see FIG. 11A) located at a second of the first end portion 219A or the second end portion 219B. The port 320A (see FIG. 11A) has an opening to interface with the second face 245B of the outer housing 204 so as to generally align with the first outlet port 220*o*. The first jumper tube 302A and the second jumper tube 302B extend in generally a same direction. Similarly, the first jumper tube 302AA and the second jumper tube 302BB extend in generally a same direction. This is due to the orientations of the faces from which the jumper tubes extend being generally corresponding in orientation to one another, respectively.

Figure 11:
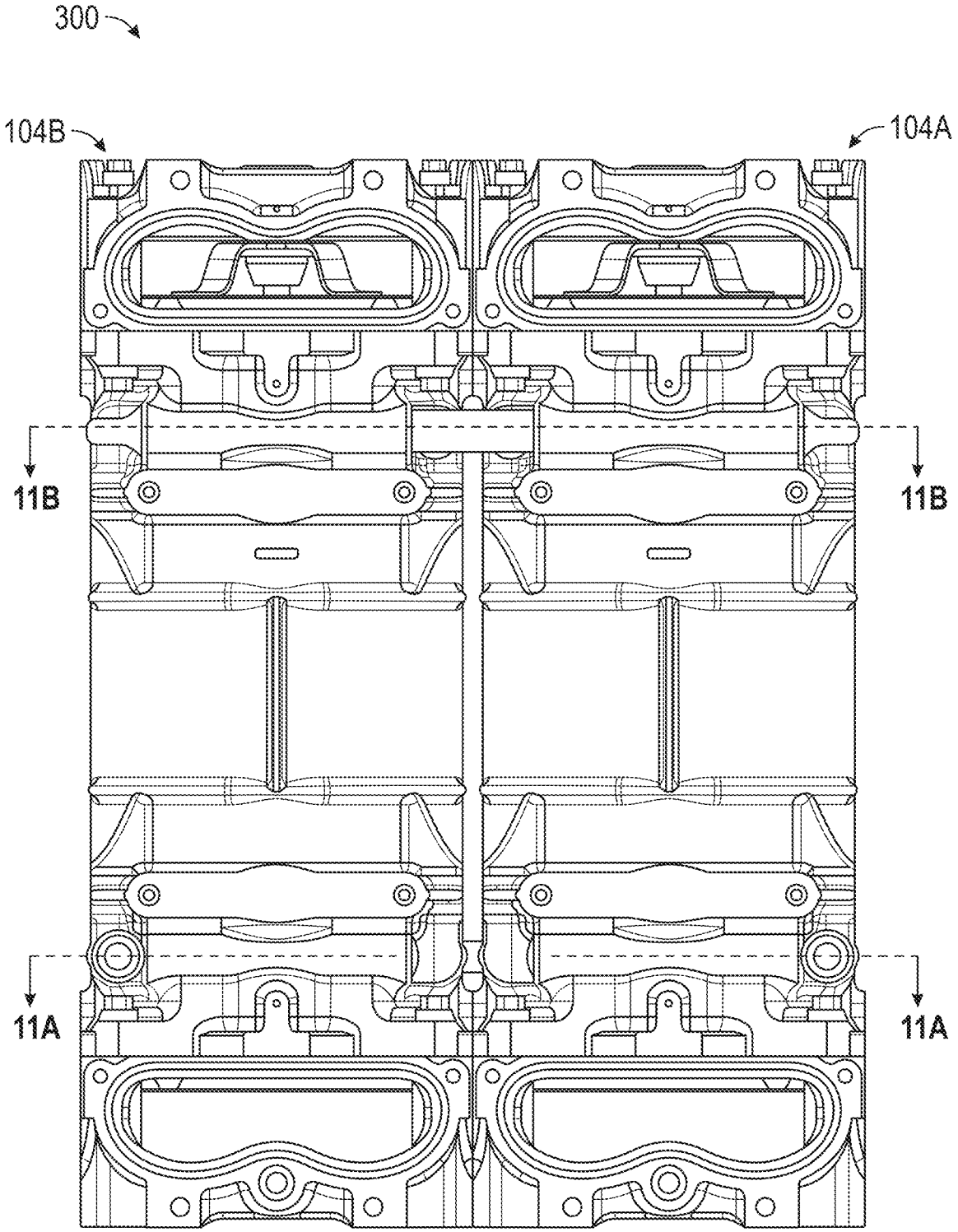
FIG. 11 is a plan view of the assembly of FIGS. 8A, 8B and 10.

FIG. 11 is a plan view of a first side of the assembly 300 showing the first oil separation device 104A and the second oil separation device 104B. The third oil separation device 104C (FIGS. 8A, 8B and 10) is obscured in FIG. 11 due to the L-shaped configuration of the assembly 300.

Figure 11A:
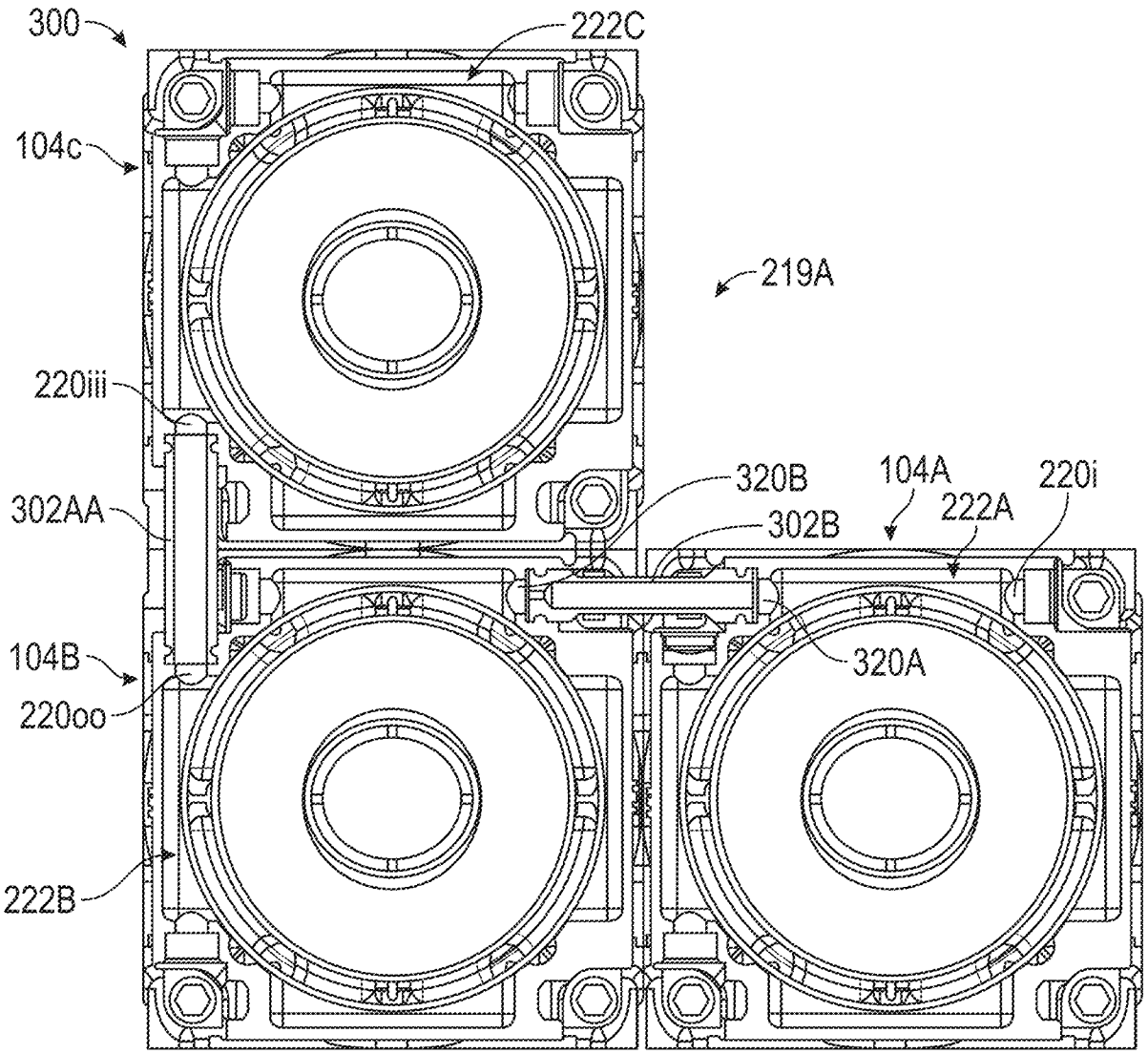
FIG. 11A is a first cross-sectional view through the assembly along the line 11A-11A in FIG. 11.

FIG. 11A is a first cross-sectional view of the assembly 300 including the first oil separation device 104A, the second oil separation device 104B, and the third oil separation device 104C taken along the line 11A-11A of FIG. 11. FIG. 11A shows some of the components and features discussed previously including the first inlet port 220*i*, the first jacket 222A, the second jumper tube 302B, the second jacket 222B, the second outlet port 220*oo*, the first jumper tube 302AA, the third inlet port 220*iii* and the third jacket 222C. The cross-section of FIG. 11A is taken at a lower end portion of the assembly 300 at the first end portion 219A at a bottom end of the first jacket 222A, second jacket 222B and third jacket 222C. FIG. 11A illustrates the generally tangential extent of the first inlet port 220*i* relative to the first jacket 222A, the generally tangential extent of the second outlet port 220*oo* and the first jumper tube 302AA relative to the second jacket 222B and the generally tangential extent of the third inlet port 220*iii* relative to the third jacket 222C.

Figure 11B:
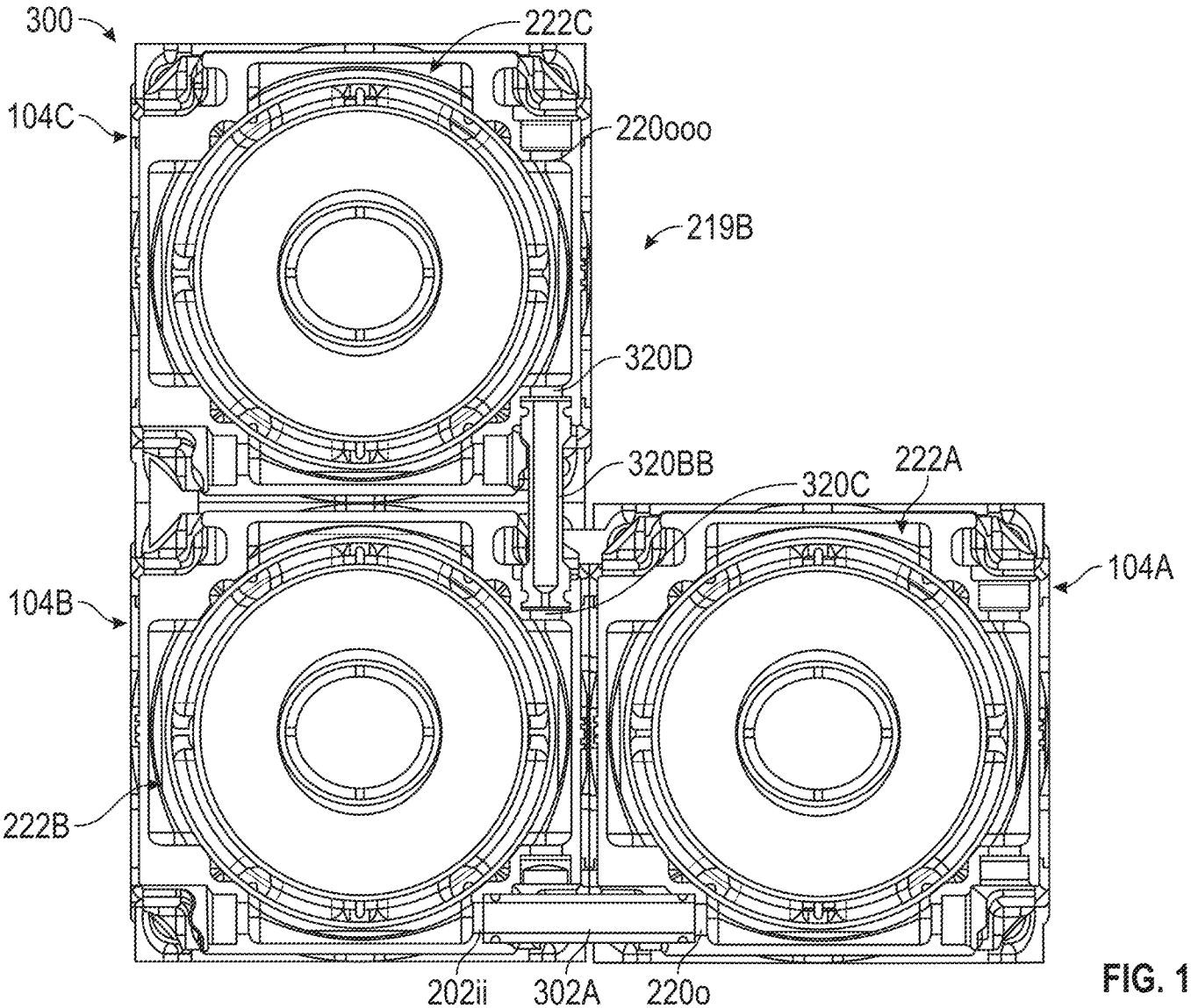
FIG. 11B is a second cross-sectional view through the assembly along the line 11B-11B in FIG. 11.

FIG. 11B is a second cross-sectional view of the assembly 300 including the first oil separation device 104A, the second oil separation device 104B, and the third oil separation device taken along the line 11B-11B of FIG. 11. FIG. 11B shows some of the components and features discussed previously including the first outlet port 220*o*, the second inlet port 220*ii*, the first jacket 222A, the second jumper tube 302BB, the second jacket 222B, the third outlet port 220*ooo*, the first jumper tube 302A and the third jacket 222C. FIG. 11B is taken at the upper end of the is taken at a upper end portion of the assembly 300 at the second end portion 219B at a upper end of the first jacket 222A, second jacket 222B and third jacket 222C. FIG. 11B illustrates the generally tangential extent of the first outlet port 220*o* relative to the first jacket 222A, the generally tangential extent of the second inlet port 220*ii* and the first jumper tube 302A relative to the second jacket 222B and the generally tangential extent of the third outlet port 220*ooo* relative to the third jacket 222C.

Figure 12:
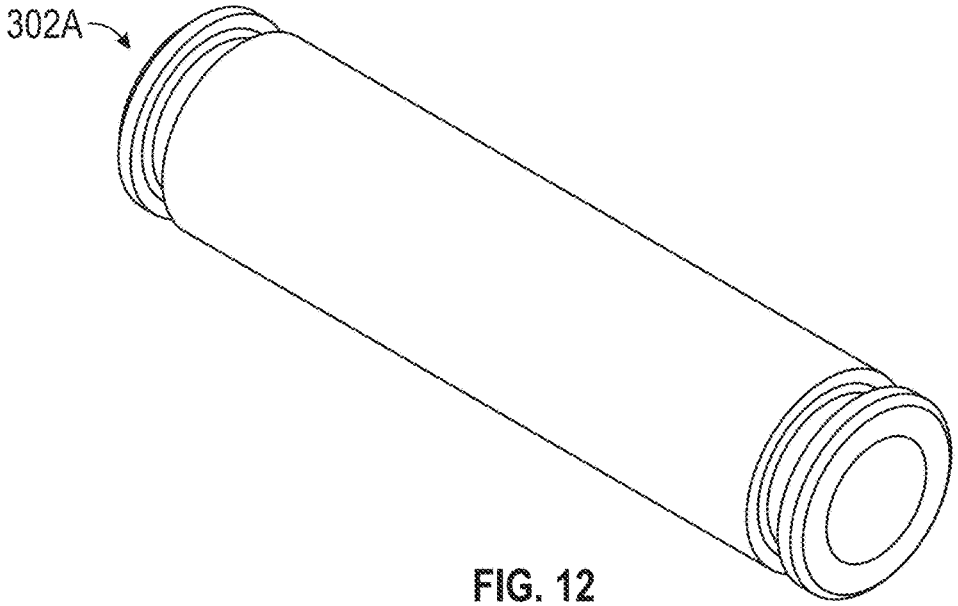
FIG. 12 is a perspective view of a first jumper tube according to one example of the present application.
Figure 12A:
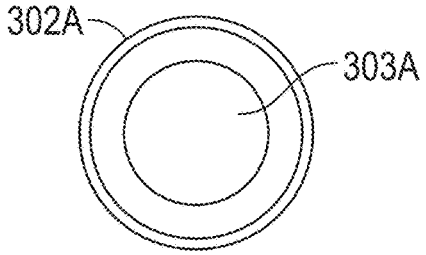
FIG. 12A is a first plan view of an end of the first jumper tube of FIG. 12.
Figure 12B:
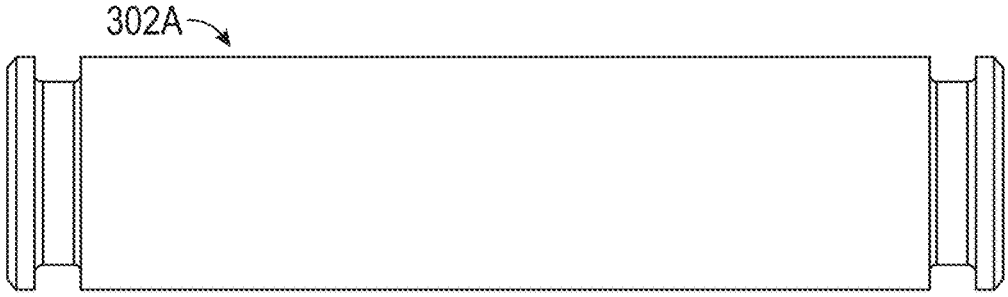
FIG. 12B is a second plan view of a side of the first jumper tube of FIG. 12.
Figure 12C:
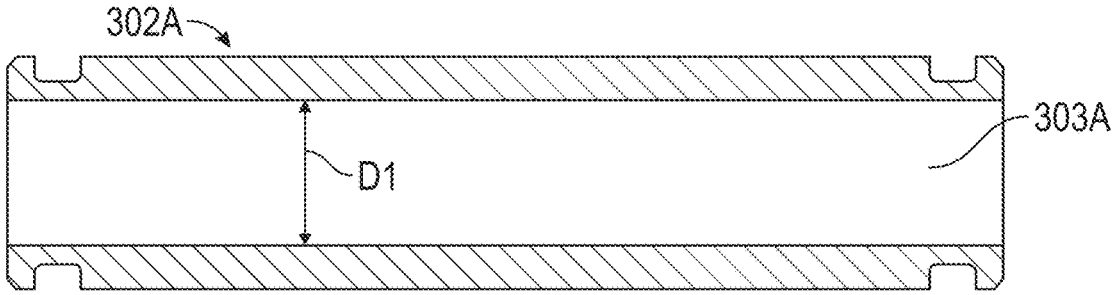
FIG. 12C is a cross-sectional view of the first jumper tube of FIGS. 12-12B.

FIGS. 12-12C show the first jumper tube 302A in further detail. The first jumper tube 302A can by cylindrical in shape with an internal passage 303A extending therethrough and can include grooves, ridges or other features for seals around outer end portions thereof. The internal passage 303A can be substantially uniform. The jumper tube 302A as shown in cross-section in FIG. 12C can include a first diameter D1 along the internal passage 303A. This diameter can be between 10 mm and 20 mm according to some examples. The elongate length of the tube can be between 75 mm and 250 mm or greater. However, other dimensions are contemplated according to other examples.

Figure 13:
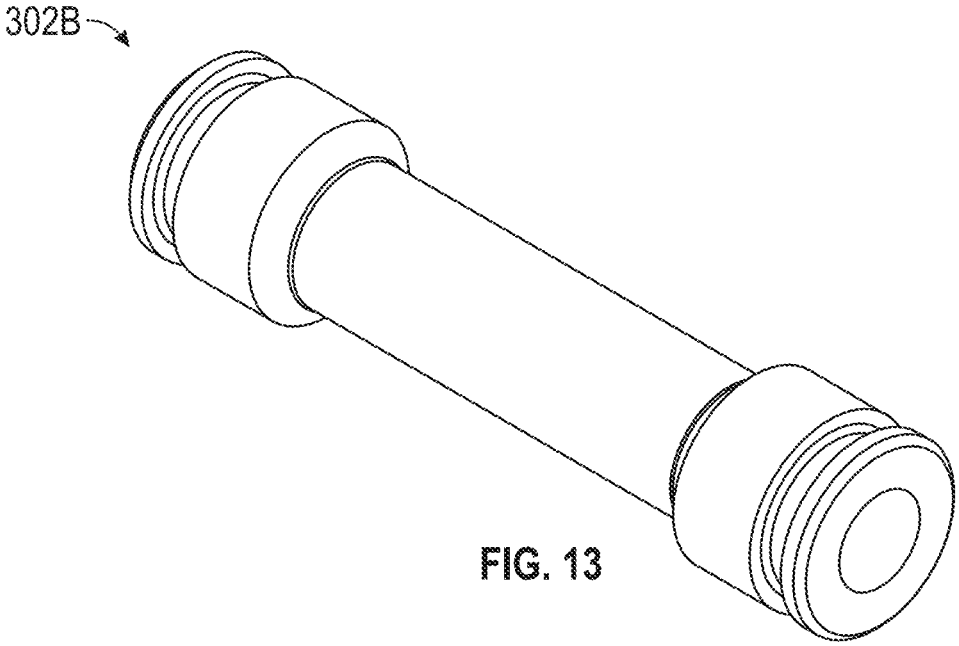
FIG. 13 is a perspective view of a second jumper tube according to one example of the present application.
Figure 13A:
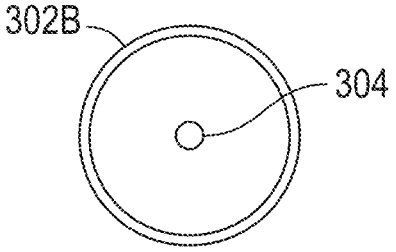
FIG. 13A is a first plan view of an end of the second jumper tube of FIG. 13.
Figure 13B:
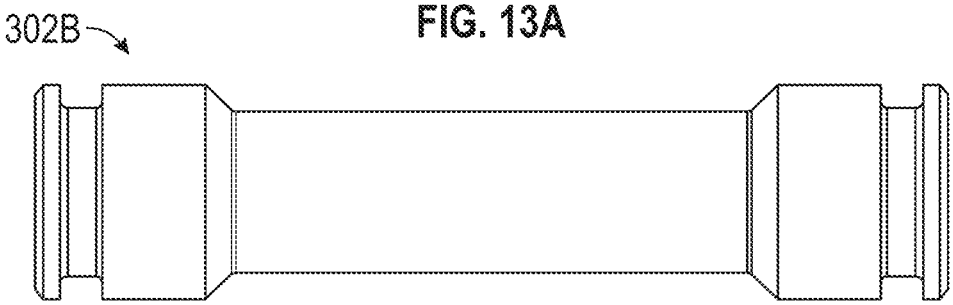
FIG. 13B is a second plan view of a side of the second jumper tube of FIG. 13.
Figure 13C:
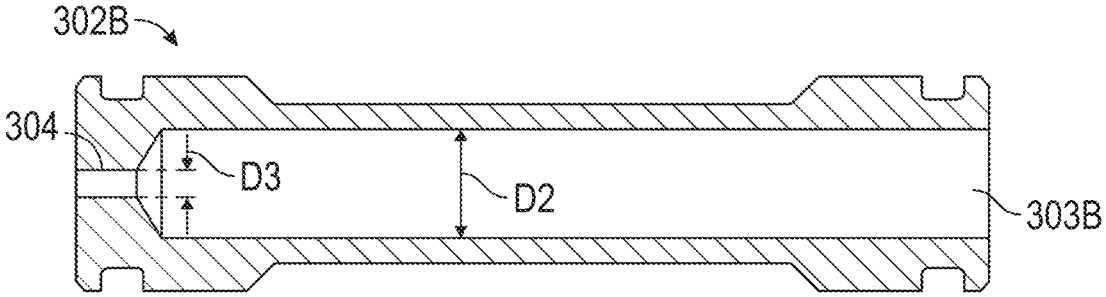
FIG. 13C is a cross-sectional view of the second jumper tube of FIGS. 13-13B.

FIGS. 13-13C show the second jumper tube 302B in further detail. The second jumper tube 302B differs in construction from the first jumper tube 302A of FIGS. 12-12C. In particular, the second jumper tube 302B as shown in FIG. 13C includes an internal passage 303B with a second diameter D2 along a majority of the length thereof. The second jumper tube 302B along the internal passage 303B includes an orifice (restriction) 304 having a third diameter D3. The second diameter D2 can be between 7.5 mm and 20 mm (e.g., can be smaller than or the same as the first diameter D1 of the first jumper tube of FIG. 12C). The third diameter D3 can be between 2 to 8 times smaller, 3 to 7 times smaller, 4 to 6 times smaller or about 5 times smaller than the first diameter D1 of the first jumper tube of FIG. 12C. The elongate length of the second jumper tube 302B can be the same as or can differ from that of the first jumper tube.

INDUSTRIAL APPLICABILITY

In operation, the engine 100 can be configured to combust fuel to generate power. While typically efficient, a small portion of the combustion gases may escape the combustion chamber past the piston as blow-by and enter undesirable areas of the engine 100 such as the crankcase. The present disclosure contemplates a system 102 including one or more oil separation devices 104 to filter oil to remove the oil from the blow-by gas.

Oil separation devices containing coalescing filters are known, however, these have disadvantages. These devices typically lack cold climate capability, they lack robustness to high heat environments, and/or they lack vibration robustness. The present application recognizes a construction for the oil separation devices 104 that utilizes the jacket 222 to cool, insulate, and/or warm the filter of the oil separation devices 104 to a desired temperature range. This improves operation of the filter in cold climate or high heat environments. The design of the oil separation devices 104 can have temperature and vibration robustness. Thus, the present oil separation devices 104 can be configured to reduce or prevent heat loss, water condensate, oil/water emulsion, and/or freezing. The oil separation devices 104 with the jacket 222 can be configured to protect temperature sensitive filtration components from over-temperature.

The present application recognizes arrangements of the inlet ports and outlet ports (e.g., the first inlet port 220*i*, second inlet port 220*ii*, third inlet port 220*iii*, the first outlet port 220*o*, second inlet port 220*oo* and/or third inlet port 220*ooo*, etc.) that extend generally tangentially relative to the respective jacket which the port is feeding into or out of. Such a configuration of the ports can result in a better more advantageous flow of fluid within the respective jacket. This results in more uniform heat transfer to the filter 207. A generally tangential inlet and outlet has been found by the inventors to minimize the pressure drop of the fluid passing thru the jacket 220. Additionally, the present inventors determined that generally tangential inlet and outlet maximizes the average velocity throughout the jacket 222, thus maximizing heat transfer efficiency of heat transfer between the jacket 222 and the filter 207. Furthermore, having fluid entering and exiting at opposite tangential corners of the jacket 222 was also determined by the inventors to maximize the average velocity throughout the jacket 222. This port arrangement was determined to maximize heat transfer efficiency from the jacket 222 to the filter 207.

The oil separation device 104 discussed has various additional features that address these and other problems.

For example, the inventors through testing determined that second jumper tubes 302B and 302BB were needed to provide for ease of service such as at startup when the jackets were required to be filled with fluid. Referring to FIG. 10, the second jumper tube 302BB is positioned to act as an air vent adapter to allow for passage of air between the third jacket and the second jacket. The second jumper tube 302B is positioned to act as a drain back adapter to allow for passage of the fluid between the first jacket and the second jacket during a servicing operation. A failure to provide for the second jumper tubes 302B and 302BB would make filling or draining the fluid from the assembly 300 much more difficult to achieve.

The oil separation device 104 can include the first cover 202 and the second cover 208 with configurations that allow blow-by gas into and from the manifold in any desired direction (housing design for first cover 202 and the second cover 208 allows for up to 360 degrees routing of the blow-by gas). As such, the oil separation device 104 offers a configurability, commonality, scalability and modularity not found with typical oil separation devices. This configurability, commonality, scalability and modularity can address a wide range of multi-displacement and different power density engine platforms. For example, the present oil separation devices 104 can be configurable directly together as assemblies such as in single row arrays, multi-row parallel arrays, multi-row series arrays, U-shaped arrays, L-shape arrays (see FIGS. 8A and 8B), T-shaped arrays, H-shaped arrays, single row arrays, etc. This modularity (the desired number of oil separation devices can be easily selected and implemented together as an array) can provide for the configurability, commonality, scalability and modularity needed to address various engine platforms. The assemblies described can be easily constructed to handle various volumes of blow-by gas and other fluids as desired for various engine and/or auxiliary component needs. The first cover 202 and the second cover 208 can both include a plurality of ports. These ports can be located along multiple sides/faces (e.g., corresponding to the four faces of the inlet and/or outlet manifolds, for example). This can allow for various routing directions of blow-by gas. Similarly, fluid for the jacket 222 can be routed between adjacent of the oil separation devices and can be routed in a desired direction due to the various plurality of ports 220 located at different faces of the outer housing 204. Additionally, the configuration disclosed herein can allow the oil separation devices to be placed in close proximity (e.g., abutting or spaced a small distance) communicating fluid for the jacket (in addition to blow-by gas) with one another as desired.

The above detailed description is intended to be illustrative, and not restrictive. The scope of the disclosure should, therefore, be determined with references to the appended claims, along with the full scope of equivalents to which such claims are entitled.

What is claimed is:

1. An engine system comprising:

an array of oil separating apparatuses, wherein the array of the oil separating apparatuses includes an assembly of at least a first oil separating apparatus and a second oil separating apparatus that are physically coupled together, wherein the first oil separating apparatus includes a first jacket and the second oil separating apparatus includes a second jacket, wherein the first jacket is in fluid communication with the second jacket via a first jumper tube, wherein, via a first inlet port, the first jacket receives a fluid flowing in a generally tangential direction relative to the first jacket and circulates the fluid from the first inlet port around the first jacket to a first outlet port communicating with the first jumper tube, and wherein the first outlet port and the first jumper tube are positioned to extend generally tangentially relative to the first jacket;

a first one or more fluid lines passing a blow-by gas from an engine to the array of the oil separating apparatuses, wherein oil is separated from the blow-by gas by passing through a first filter of the first oil separating apparatus and a second filter of the second oil separating apparatus, wherein the first jacket surrounds, thermally protects and is sealed as to be entirely separated from the first filter and the second jacket surrounds, thermally protects and is sealed so as to be entirely separated from the second filter; and a second one or more fluid lines passing the blow-by gas from the array of the oil separating apparatuses back to the engine.

2. The engine system of claim 1, further comprising a second jumper tube having a construction that differs from a construction of the first jumper tube, wherein the first jacket is in additional fluid communication with the second jacket via the second jumper tube, wherein the first jumper tube has a first passage therethrough and the second jumper tube has a second passage therethrough, wherein a diameter of the first passage is larger than a diameter of the second passage, and wherein the second jumper tube is positioned to act as one of an air vent adapter to allow for passage of air between the first jacket and the second jacket or a drain back adapter to allow for passage of the fluid between the first jacket and the second jacket during a servicing operation performed on the array.

3. The engine system of claim 1, wherein, via a second inlet port in communication with the first jumper tube, the second jacket receives the fluid flowing in a generally tangential direction relative to the second jacket and circulates the fluid from the second inlet port around the second jacket to a second outlet port, and wherein the second inlet port, the second outlet port and the first jumper tube are positioned to extend generally tangentially relative to the second jacket.

4. The engine system of claim 3, wherein the first inlet port is configured to communicate with the first jacket to introduce the fluid into the first jacket as a flow in a first direction and the first outlet port is configured to communicate with the first jacket to route the flow of the fluid from the first jacket in the first direction or an orthogonal direction to the first direction through the first jumper tube.

5. The engine system of claim 4, wherein the first inlet port is located at a first tangential corner of the first jacket and the first outlet port is located at a second tangential corner of the first jacket, wherein the first tangential corner is opposite from the second tangential corner, wherein the second inlet port is located at a third tangential corner of the second jacket and the second outlet port is located at a fourth tangential corner of the second jacket, wherein the third tangential corner is opposite from the fourth tangential corner.

* * * * *